US010674791B2

(12) United States Patent
Bruce et al.

(10) Patent No.: US 10,674,791 B2
(45) Date of Patent: Jun. 9, 2020

(54) BRAIDED ARTICLE WITH INTERNAL MIDSOLE STRUCTURE

(71) Applicant: NIKE, Inc., Beaverton, OR (US)

(72) Inventors: Robert M. Bruce, Portland, OR (US); Eun Kyung Lee, Beaverton, OR (US); Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/565,598

(22) Filed: Dec. 10, 2014

(65) Prior Publication Data

US 2016/0166007 A1 Jun. 16, 2016

(51) Int. Cl.

| | |
|---|---|
| ***A43B 23/04*** | (2006.01) |
| ***D04C 1/06*** | (2006.01) |
| ***A43D 11/00*** | (2006.01) |
| ***D04C 3/48*** | (2006.01) |
| ***A43B 1/04*** | (2006.01) |
| ***A43B 13/12*** | (2006.01) |

(52) U.S. Cl.

CPC ..... *A43B 23/042* (2013.01); *A43B 1/04* (2013.01); *A43B 13/125* (2013.01); *A43D 11/006* (2013.01); *D04C 1/06* (2013.01); *D04C 3/48* (2013.01); *D10B 2501/043* (2013.01)

(58) Field of Classification Search

CPC ..... A43B 13/16; A43B 13/38; A43B 23/042; A43B 1/04; A43D 11/006

USPC ..... 36/31; 12/133 R, 145, 146 C, 128 D, 12/128 C, 139, 141, 133 C; 87/34

See application file for complete search history.

(56) References Cited

U.S. PATENT DOCUMENTS

| | | | |
|---|---|---|---|
| 165,941 | A | 7/1875 | Malhebe |
| 329,739 | A | 11/1885 | Heostkels |
| 376,372 | A | 1/1888 | Dodge et al. |
| 509,241 | A | 11/1893 | Paokaed |
| 578,294 | A | 3/1897 | Leayitt |
| 586,137 | A | 7/1897 | Medger |
| 621,922 | A | 3/1899 | Kelsall |
| 1,182,325 | A | 5/1916 | Sedmak |
| 1,318,888 | A | 10/1919 | Le Carpentier |
| 1,527,344 | A | 2/1925 | Bente et al. |
| 1,538,160 | A | 5/1925 | Bosebeck |
| 1,540,903 | A | 6/1925 | Santoyo |
| 1,554,325 | A | 9/1925 | Bente |

(Continued)

FOREIGN PATENT DOCUMENTS

| | | | |
|---|---|---|---|
| BE | 426458 | A | 3/1938 |
| CN | 86209002 | U | 10/1987 |

(Continued)

OTHER PUBLICATIONS

Pending U.S. Appl. No. 14/565,582, filed Dec. 10, 2014.

(Continued)

*Primary Examiner* — Anna K Kinsaul
*Assistant Examiner* — F Griffin Hall
(74) *Attorney, Agent, or Firm* — Shook, Hardy and Bacon LLP

(57) ABSTRACT

A method of making an article of footwear includes temporarily attaching a midsole structure to a last and inserting the midsole structure and footwear last through a braiding machine. A braided structure in the form of an upper is formed. The upper includes a midsole structure disposed within an interior cavity of the upper.

13 Claims, 15 Drawing Sheets

(56) References Cited

U.S. PATENT DOCUMENTS 1,583,273 A 5/1926 Bosebeck
1,597,934 A 8/1926 Stimpson
1,600,621 A 9/1926 Buek, Jr.
1,622,021 A 3/1927 Birkin et al.
1,637,716 A 8/1927 Turck
1,663,319 A 3/1928 Snell
1,687,643 A 10/1928 Berliner
1,713,307 A 5/1929 Stritter
1,717,183 A 6/1929 Brenner
1,803,554 A 5/1931 Knilans
1,828,320 A 10/1931 Daniels
1,832,691 A 11/1931 David
1,864,254 A 6/1932 Meyer
1,877,080 A 9/1932 Teshima
1,887,643 A 11/1932 Huber
1,949,318 A 2/1934 Markowsky
2,001,293 A 5/1935 Wilson
2,022,350 A 11/1935 Huber
2,091,215 A 8/1937 Price
2,144,689 A 1/1939 Roberts
2,147,197 A 2/1939 Glidden
2,161,472 A 6/1939 Hurwit
2,162,472 A 6/1939 Scharf
2,165,092 A 7/1939 Daniels
2,188,640 A 1/1940 Bloch et al.
RE21,392 E 3/1940 Hurwit
2,271,888 A 2/1942 Manley
2,311,959 A 2/1943 Nurk
D137,767 S 4/1944 Goldstein
2,382,559 A 8/1945 Goldstein
2,412,808 A 12/1946 Goldstein
2,521,072 A 9/1950 Lovell
D164,847 S 10/1951 Dronoff
2,586,045 A 2/1952 Hoza
2,617,129 A 11/1952 Petze
2,641,004 A 6/1953 Whiting et al.
2,675,631 A 4/1954 Doughty
2,679,117 A 5/1954 Reed
2,701,887 A 2/1955 Nolan
2,936,670 A 5/1960 Erwin
3,052,904 A * 9/1962 Reid ..... A43D 3/022 12/142 R
3,257,677 A * 6/1966 Batchelder ..... A43D 3/022 12/142 R
3,282,757 A 11/1966 Brussee
3,397,847 A 8/1968 Thaden
3,474,478 A 10/1969 Batchelder et al.
3,504,450 A 4/1970 Steadman et al.
3,525,110 A 8/1970 Rubico
3,586,058 A 6/1971 Ahrens et al.
3,619,838 A 11/1971 Winkler
3,745,600 A 7/1973 Rubico et al.
3,805,667 A 4/1974 Orser
3,821,827 A * 7/1974 Nadler ..... A43B 15/00 12/142 C
4,134,955 A 1/1979 Hanrahan, Jr. et al.
4,149,249 A 4/1979 Pavkovich
4,194,249 A 3/1980 Thorneburg
4,222,183 A 9/1980 Haddox
4,232,458 A 11/1980 Bartels
4,275,638 A 6/1981 DeYoung
4,341,097 A 7/1982 Cassidy et al.
4,351,889 A 9/1982 Sundberg
4,394,803 A 7/1983 Goldstein
4,430,811 A 2/1984 Okada
4,447,967 A 5/1984 Zaino
4,519,290 A 5/1985 Inman et al.
4,587,749 A 5/1986 Berlese
4,591,155 A 5/1986 Adachi
4,629,650 A 12/1986 Kataoka
4,640,027 A 2/1987 Berlese
4,662,088 A 5/1987 Autry et al.
4,719,837 A 1/1988 McConnell et al.
4,785,558 A 11/1988 Shiomura
4,847,063 A 6/1989 Smith
4,848,745 A 7/1989 Bohannan et al.
4,857,124 A 8/1989 Shobert et al.
4,882,858 A 11/1989 Signori
4,885,973 A 12/1989 Spain
4,916,997 A 4/1990 Spain
4,919,388 A 4/1990 Koike et al.
4,974,275 A 12/1990 Backes et al.
4,976,812 A 12/1990 McConnell et al.
4,992,313 A 2/1991 Shobert et al.
5,001,961 A 3/1991 Spain
D315,823 S 4/1991 Signori
5,067,525 A 11/1991 Tsuzuki et al.
5,121,329 A 6/1992 Crump et al.
5,201,952 A 4/1993 Yahagi et al.
5,203,249 A 4/1993 Adams et al.
5,257,571 A 11/1993 Richardson
5,287,790 A 2/1994 Akiyama et al.
5,335,517 A 8/1994 Throneburg et al.
5,345,638 A 9/1994 Nishida
5,348,056 A 9/1994 Tsuzuki
5,361,674 A 11/1994 Akiyama et al.
5,381,610 A 1/1995 Hanson
5,388,497 A 2/1995 Akiyama et al.
5,396,829 A 3/1995 Akiyama et al.
5,398,586 A 3/1995 Akiyama
5,439,215 A 8/1995 Ratchford
5,476,027 A 12/1995 Uchida et al.
5,647,150 A 7/1997 Romanato et al.
5,732,413 A 3/1998 Williams
5,885,622 A 3/1999 Daley
5,896,758 A 4/1999 Rock et al.
5,901,632 A 5/1999 Ryan
6,024,005 A 2/2000 Uozumi
6,029,376 A 2/2000 Cass
6,205,683 B1 * 3/2001 Clark ..... A43B 13/12 36/102
6,298,582 B1 10/2001 Friton et al.
6,308,536 B2 10/2001 Roell
6,345,598 B1 2/2002 Bogdanovich et al.
6,401,364 B1 6/2002 Burt
6,451,046 B1 9/2002 Leo et al.
6,482,492 B1 11/2002 Hung
6,510,961 B1 1/2003 Head et al.
6,588,237 B2 7/2003 Cole et al.
6,679,152 B1 1/2004 Head et al.
6,696,001 B1 2/2004 Quddus
6,826,853 B1 12/2004 Zanatta
6,910,288 B2 6/2005 Dua
6,931,762 B1 8/2005 Dua
6,945,153 B2 9/2005 Knudsen et al.
6,971,252 B2 12/2005 Therin et al.
7,004,967 B2 2/2006 Chouinard et al.
7,093,527 B2 8/2006 Rapaport et al.
7,168,951 B2 1/2007 Fischer et al.
7,204,903 B2 4/2007 Yasui
7,228,777 B2 6/2007 Morissette et al.
7,252,028 B2 8/2007 Bechtold et al.
7,262,353 B2 8/2007 Bartholomew et al.
7,275,471 B2 10/2007 Nishri et al.
7,293,371 B2 11/2007 Aveni
7,300,014 B2 11/2007 Allen
7,347,011 B2 3/2008 Dua et al.
D578,294 S 10/2008 Mervar et al.
7,430,818 B2 10/2008 Valat et al.
7,444,916 B2 11/2008 Hirukawa
7,549,185 B2 6/2009 Yang
7,566,376 B2 7/2009 Matsuoka
7,703,218 B2 4/2010 Burgess
7,793,434 B2 9/2010 Sokolowski et al.
7,793,576 B2 9/2010 Head et al.
7,815,141 B2 10/2010 Uozumi et al.
7,836,608 B2 11/2010 Greene
7,870,681 B2 1/2011 Meschter
7,908,956 B2 3/2011 Dow et al.
7,913,426 B2 3/2011 Valat et al.
7,938,853 B2 5/2011 Chouinard et al.
7,941,942 B2 5/2011 Hooper et al.
7,963,747 B2 6/2011 Cairo
8,006,601 B2 8/2011 Inazawa et al.

(56) References Cited

U.S. PATENT DOCUMENTS 8,051,585 B2 11/2011 Hope et al.
8,056,173 B2 11/2011 RongBo
8,061,253 B2 11/2011 Wybrow
8,210,086 B2 7/2012 Head et al.
8,261,648 B1 9/2012 Marchand et al.
8,266,827 B2 9/2012 Dojan et al.
8,312,645 B2 11/2012 Dojan et al.
8,312,646 B2 11/2012 Meschter et al.
8,388,791 B2 3/2013 Dojan et al.
8,394,222 B2 3/2013 Rettig
8,438,757 B2 5/2013 Roser
8,511,214 B2 8/2013 Gries
8,544,197 B2 10/2013 Spanks et al.
8,544,199 B1 10/2013 Pentland
8,578,534 B2 11/2013 Langvin et al.
8,578,632 B2 11/2013 Bell et al.
8,651,007 B2 2/2014 Adams
8,690,962 B2 4/2014 Dignam et al.
8,757,038 B2 6/2014 Siegismund
8,770,081 B2 7/2014 David et al.
8,789,295 B2 7/2014 Burch et al.
8,789,452 B1 7/2014 Janardhan et al.
8,794,118 B2 8/2014 Dow et al.
8,819,963 B2 9/2014 Dojan et al.
8,959,959 B1 2/2015 Podhajny
8,984,776 B2 3/2015 Ludemann et al.
8,997,529 B1 4/2015 Podhajny
D737,561 S 9/2015 Aveni et al.
9,179,739 B2 11/2015 Bell et al.
D769,590 S 10/2016 Aveni et al.
9,681,708 B2 6/2017 Greene et al.
9,756,901 B2 9/2017 Musho et al.
D798,565 S 10/2017 Aveni et al.
10,159,297 B2 12/2018 Jamison
2001/0007180 A1 7/2001 Bordin et al.
2003/0000111 A1 1/2003 Basso
2003/0213547 A1 11/2003 Ono et al.
2004/0118018 A1 6/2004 Dua
2004/0244412 A1 12/2004 Trinh et al.
2005/0076536 A1 4/2005 Hatfield et al.
2005/0081402 A1 4/2005 Orei et al.
2005/0115284 A1 6/2005 Dua
2005/0178026 A1 8/2005 Friton
2005/0193592 A1 9/2005 Dua et al.
2005/0208860 A1 9/2005 Baron et al.
2005/0284002 A1 12/2005 Aveni
2006/0048413 A1 3/2006 Sokolowski et al.
2006/0059715 A1 3/2006 Aveni
2006/0260365 A1 11/2006 Miyamoto
2006/0265908 A1 11/2006 Palmer et al.
2006/0283042 A1 12/2006 Greene et al.
2006/0283048 A1 12/2006 Lebo
2007/0022627 A1 2/2007 Sokolowski et al.
2007/0062067 A1 3/2007 Covatch
2007/0101615 A1 5/2007 Munns
2007/0101616 A1 5/2007 Munns
2007/0180730 A1 8/2007 Greene et al.
2007/0245595 A1 10/2007 Chen et al.
2007/0271821 A1 11/2007 Meschter
2007/0271822 A1 11/2007 Meschter
2008/0005930 A1 1/2008 Skirrow
2008/0022553 A1 1/2008 McDonald et al.
2008/0078103 A1 4/2008 Liles
2008/0110048 A1* 5/2008 Dua ..... A43B 1/04 36/45
2008/0250668 A1 10/2008 Marvin et al.
2009/0126225 A1 5/2009 Jarvis
2009/0126823 A1 5/2009 Yengkhom
2009/0193961 A1 8/2009 Jensen et al.
2009/0241374 A1 10/2009 Sato et al.
2009/0306762 A1 12/2009 McCullagh et al.
2010/0018075 A1 1/2010 Meschter et al.
2010/0043253 A1 2/2010 Dojan et al.
2010/0095556 A1 4/2010 Jarvis
2010/0095557 A1 4/2010 Jarvis
2010/0107442 A1 5/2010 Hope et al.
2010/0139057 A1 6/2010 Soderberg et al.
2010/0154256 A1 6/2010 Dua
2010/0175276 A1 7/2010 Dojan et al.
2010/0199520 A1 8/2010 Dua et al.
2010/0251491 A1 10/2010 Dojan et al.
2010/0251564 A1 10/2010 Meschter
2010/0319215 A1 12/2010 Roser
2011/0041359 A1 2/2011 Dojan et al.
2011/0067271 A1 3/2011 Foxen et al.
2011/0078921 A1 4/2011 Greene et al.
2011/0088285 A1 4/2011 Dojan et al.
2011/0094127 A1 4/2011 Dana, III
2011/0146104 A1 6/2011 Lafortune
2011/0239486 A1 10/2011 Berger et al.
2011/0266384 A1 11/2011 Goodman et al.
2012/0023786 A1 2/2012 Dojan
2012/0030965 A1 2/2012 Greene et al.
2012/0055044 A1 3/2012 Dojan et al.
2012/0066931 A1 3/2012 Dojan et al.
2012/0096742 A1 4/2012 Shim
2012/0117826 A1 5/2012 Jarvis
2012/0144698 A1 6/2012 McDowell
2012/0159813 A1 6/2012 Dua et al.
2012/0186102 A1 7/2012 Lee et al.
2012/0198730 A1 8/2012 Burch et al.
2012/0233882 A1 9/2012 Huffa et al.
2012/0234052 A1 9/2012 Huffa et al.
2012/0240429 A1 9/2012 Sokolowski et al.
2012/0246973 A1 10/2012 Dua
2012/0255201 A1 10/2012 Little
2012/0279260 A1 11/2012 Dua et al.
2012/0291314 A1 11/2012 Sokolowski et al.
2012/0297643 A1 11/2012 Shaffer et al.
2013/0019500 A1 1/2013 Greene
2013/0025157 A1 1/2013 Wan et al.
2013/0055590 A1 3/2013 Mokos
2013/0081307 A1 4/2013 del Biondi et al.
2013/0125420 A1 5/2013 Raghuprasad
2013/0174446 A1 7/2013 Antonelli et al.
2013/0211492 A1 8/2013 Schneider
2013/0219636 A1 8/2013 Dojan et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0269159 A1 10/2013 Robitaille et al.
2013/0269209 A1 10/2013 Lang et al.
2013/0269212 A1 10/2013 Little
2013/0291293 A1 11/2013 Jessiman et al.
2013/0304232 A1 11/2013 Gries
2013/0305465 A1* 11/2013 Siegismund ..... A43B 9/12 12/146 C
2013/0305911 A1 11/2013 Masson et al.
2013/0312284 A1 11/2013 Berend et al.
2014/0000043 A1 1/2014 Boardman et al.
2014/0007458 A1 1/2014 Berger et al.
2014/0068838 A1 3/2014 Beers et al.
2014/0070042 A1 3/2014 Beers et al.
2014/0082905 A1 3/2014 Wen
2014/0088688 A1 3/2014 Lilbum et al.
2014/0109441 A1 4/2014 McDowell et al.
2014/0130372 A1 5/2014 Aveni et al.
2014/0134405 A1 5/2014 Yang
2014/0137433 A1 5/2014 Craig
2014/0137434 A1 5/2014 Craig
2014/0150292 A1 6/2014 Podhajny et al.
2014/0173932 A1 6/2014 Bell
2014/0173934 A1 6/2014 Bell
2014/0173935 A1 6/2014 Sabbioni
2014/0182447 A1 7/2014 Kang et al.
2014/0189964 A1 7/2014 Wen et al.
2014/0196316 A1 7/2014 Follet
2014/0215850 A1 8/2014 Redl et al.
2014/0237854 A1* 8/2014 Fallon ..... A43B 1/04 36/84
2014/0245633 A1 9/2014 Podhajny
2014/0259760 A1 9/2014 Dojan et al.
2014/0310983 A1 10/2014 Tamm et al.

(56) References Cited

U.S. PATENT DOCUMENTS

| | | | | |
|---|---|---|---|---|
| 2014/0310984 | A1 | 10/2014 | Tamm et al. | |
| 2014/0310987 | A1 | 10/2014 | Sokolowski et al. | |
| 2014/0338222 | A1 | 11/2014 | Song | |
| 2014/0352173 | A1 | 12/2014 | Bell et al. | |
| 2014/0373389 | A1 | 12/2014 | Bruce | |
| 2014/0377488 | A1 | 12/2014 | Jamison | |
| 2015/0007451 | A1 | 1/2015 | Bruce | |
| 2015/0013187 | A1 | 1/2015 | Taniguchi et al. | |
| 2015/0052778 | A1 | 2/2015 | Kirk et al. | |
| 2015/0075031 | A1 | 3/2015 | Podhajny et al. | |
| 2015/0143716 | A1 | 5/2015 | Long et al. | |
| 2015/0143720 | A1 | 5/2015 | Avar | |
| 2015/0201705 | A1 | 7/2015 | Doremus et al. | |
| 2015/0201707 | A1 | 7/2015 | Bruce | |
| 2015/0202915 | A1 | 7/2015 | Lee | |
| 2015/0272274 | A1 | 10/2015 | Berns et al. | |
| 2015/0282564 | A1 | 10/2015 | Meschter et al. | |
| 2015/0282565 | A1 | 10/2015 | Kilgore | |
| 2015/0305442 | A1 | 10/2015 | Ravindran | |
| 2015/0313316 | A1 | 11/2015 | Boucher et al. | |
| 2015/0320139 | A1 | 11/2015 | Peitzker et al. | |
| 2015/0342286 | A1 | 12/2015 | Huffman et al. | |
| 2015/0374064 | A1* | 12/2015 | Pierobon | A43B 17/107 36/3 R |
| 2016/0021979 | A1 | 1/2016 | Iuchi et al. | |
| 2016/0029736 | A1 | 2/2016 | Meir | |
| 2016/0058100 | A1 | 3/2016 | Dealey et al. | |
| 2016/0076178 | A1* | 3/2016 | Head | D04C 3/40 87/32 |
| 2016/0095377 | A1 | 4/2016 | Tamm | |
| 2016/0106182 | A1 | 4/2016 | Yun | |
| 2016/0166000 | A1* | 6/2016 | Bruce | A43B 23/0265 |
| 2016/0166007 | A1 | 6/2016 | Bruce et al. | |
| 2016/0166010 | A1* | 6/2016 | Bruce | D04C 3/48 12/133 R |
| 2016/0168774 | A1 | 6/2016 | Breithaupt et al. | |
| 2016/0174660 | A1 | 6/2016 | Iuchi et al. | |
| 2016/0185062 | A1 | 6/2016 | Boucher et al. | |
| 2016/0208421 | A1 | 7/2016 | Baines et al. | |
| 2016/0213095 | A1 | 7/2016 | Kohatsu et al. | |
| 2016/0345675 | A1 | 12/2016 | Bruce et al. | |
| 2017/0035149 | A1 | 2/2017 | Bruce et al. | |
| 2017/0265596 | A1 | 9/2017 | Bruce et al. | |
| 2017/0325545 | A1 | 11/2017 | Becker et al. | |
| 2017/0325546 | A1 | 11/2017 | Becker et al. | |
| 2018/0213878 | A1 | 8/2018 | Bruce | |
| 2018/0242689 | A1 | 8/2018 | Bruce et al. | |
| 2018/0343962 | A1 | 12/2018 | Bruce et al. | |
| 2018/0343963 | A1 | 12/2018 | Bruce et al. | |
| 2018/0368506 | A1 | 12/2018 | Bruce et al. | |
| 2019/0098955 | A1 | 4/2019 | Bruce | |
| 2019/0150552 | A1 | 5/2019 | Casillas et al. | |
| 2019/0254386 | A1 | 8/2019 | Bruce et al. | |

FOREIGN PATENT DOCUMENTS

| | | | |
|---|---|---|---|
| CN | 1121403 | A | 5/1996 |
| CN | 2930360 | Y | 8/2000 |
| CN | 1883325 | A | 12/2006 |
| CN | 201175007 | Y | 1/2009 |
| CN | 201356120 | Y | 12/2009 |
| CN | 101627843 | A | 1/2010 |
| CN | 101801229 | A | 8/2010 |
| CN | 102271548 | A | 12/2011 |
| CN | 202635759 | U | 1/2013 |
| CN | 102987631 | A | 3/2013 |
| CN | 202950101 | U | 5/2013 |
| CN | 203369442 | U | 1/2014 |
| CN | 203676256 | U | 7/2014 |
| CN | 20403521 | U | 12/2014 |
| DE | 726634 | C | 10/1942 |
| DE | 1140107 | B | 11/1962 |
| DE | 4306286 | A1 | 9/1993 |
| DE | 102011011185 | A1 | 8/2012 |
| DE | 102011119245 | A1 | 10/2012 |
| EP | 0372370 | A2 | 6/1990 |
| EP | 1486601 | A1 | 12/2004 |
| EP | 2657384 | A1 | 10/2013 |
| EP | 2792261 | A1 | 10/2014 |
| EP | 2792264 | A2 | 10/2014 |
| EP | 2811056 | A1 | 12/2014 |
| EP | 3011855 | A1 | 4/2016 |
| FR | 1012719 | A | 7/1952 |
| GB | 430805 | A | 6/1935 |
| GB | 477556 | A | 1/1938 |
| GB | 1083849 | | 9/1967 |
| GB | 1299353 | | 12/1972 |
| JP | S51107964 | U1 | 8/1976 |
| JP | H07054250 | A | 2/1995 |
| JP | H0733076 | B2 | 4/1995 |
| JP | H07216703 | A | 8/1995 |
| JP | 08109553 | | 4/1996 |
| JP | H09322810 | A | 12/1997 |
| JP | H10158965 | A | 6/1998 |
| JP | 2001-030361 | A | 2/2001 |
| JP | 2004105323 | A | 4/2004 |
| JP | 2004339651 | A | 12/2004 |
| JP | 2005042266 | A | 2/2005 |
| JP | 2005102933 | A | 4/2005 |
| JP | 2006009175 | A | 1/2006 |
| JP | 2006161167 | A | 6/2006 |
| JP | 2008240187 | A | 10/2008 |
| JP | 2005290628 | A | 10/2015 |
| KR | 20020038168 | A | 5/2002 |
| KR | 100737426 | B1 | 7/2007 |
| WO | 00/07475 | A1 | 2/2000 |
| WO | 0036943 | A1 | 6/2000 |
| WO | O03016036 | A2 | 2/2003 |
| WO | 2009000371 | A1 | 12/2008 |
| WO | 2010080182 | A1 | 7/2010 |
| WO | 2011082391 | A1 | 7/2011 |
| WO | 2011111564 | A1 | 9/2011 |
| WO | 2011126837 | A2 | 10/2011 |
| WO | 2011137405 | A1 | 11/2011 |
| WO | 2013071679 | A1 | 5/2013 |
| WO | 2013126313 | A2 | 8/2013 |
| WO | 2014134244 | A1 | 9/2014 |
| WO | 2014209594 | A1 | 12/2014 |
| WO | 2014209596 | A1 | 12/2014 |
| WO | 2016093961 | A1 | 6/2016 |
| WO | 2016191478 | A1 | 12/2016 |

OTHER PUBLICATIONS

Branscomb et al., "New Directions in Braiding", Journal of Engineered Fibers and Fabrics, vol. 8, Issue Feb. 2013 Braiding, Journal of Engineered Fibers and Fabrics, vol. 8, Issue Feb. 2013—http://www.jeffournal.org, pp. 11-24.

International Search Report and Written Opinion dated Sep. 19, 2014 in PCT/US2014/041659. 10 pages.

International Search Report and Written Opinion dated Sep. 23, 2016 in International Patent Application No. PCT/2016/034109, 18 pages.

International Search Report and Written Opinion dated Sep. 23, 2014 in International Patent Application No. PCT/US2014/041669. 10 pages.

International Search Report and Written Opinion dated Jan. 12, 2017 in International Patent Application No. PCT/2016/045313, 15 pages.

International Search Report and Written Opinion dated Aug. 19, 2016 for International Patent Application No. PCT/US2016/034107, 17 pages.

Final Office Action dated Feb. 23, 2017 in U.S. Appl. No. 14/495,252, 15 pages.

http://www.apparelsearch.com/definitions/miscellaneous/braiding.htm.

Non-Final Office Action dated Jun. 22, 2016 in U.S. Appl. No. 14/495,252, 13 pages.

Canadian Examiner's Report dated Sep. 19, 2016 in Canadian Patent Application No. 2,910,349, 3 pages.

(56) References Cited

OTHER PUBLICATIONS

European Search Report dated Mar. 14, 2017 for European Patent Application No. 16001887.5, 9 pages.
Canadian Examiner's Report dated Jun. 13, 2017 in Canadian Patent Application No. 2,910,350, 3 pages.
Non-Final Office Action dated Jun. 22, 2017 in U.S. Appl. No. 14/495,252, 13 pages.
Australian Office Action dated May 28, 2016 for Australian Patent Application No. 2014303040, 6 Pages.
Australian Office Action dated May 28, 2016 for Australian Patent Application No. 2014303042, 5 Pages.
Non-Final Office Action dated Jan. 17, 2017 in U.S. Appl. No. 14/721,507, 12 pages.
Final Office Action dated Feb. 16, 2017 in U.S. Appl. No. 14/163,438, 17 pages.
Non-Final Office Action dated Aug. 19, 2016 for U.S. Appl. No. 14/163,438, 15 pages.
Non-Final Office Action dated Jun. 1, 2016 for U.S. Appl. No. 14/565,568, 5 pages.
International Search Report and Written Opinion dated Apr. 4, 2016 for International Patent Application No. PCT/US2015055902, 17 pages.
International Search Report and Written Opinion dated Jun. 16, 2016 in International Patent Application No. PCT/US2015/055868, 11 pages.
International Preliminary Report on Patentability dated Jun. 22, 2017 in International Patent Application No. PCT/US2015/056533, 6 pages.
International Preliminary Report on Patentability dated Jun. 22, 2017 in International Patent Application No. PCT/US2015/055868, 10 pages.
International Preliminary Report on Patentability dated Jun. 22, 2017 in International Patent Application No. PCT/US2015/055902, 10 pages.
Canadian Examiner's Report dated Jun. 28, 2017 in Canadian Patent Application No. 2,910,349, 3 pages.
Non-Final Office Action dated Sep. 14, 2017 in U.S. Appl. No. 14/820,822, 14 pages.
Office Action dated Nov. 24, 2017 in Australian Patent Application No. 2015361198, 3 pages.
International Preliminary Report on Patentability dated Dec. 7, 2017 in International Patent Application No. PCT/US2016/034109, 11 pages.
International Preliminary Report on Patentability dated Dec. 7, 2017 in International Patent Application No. PCT/US2016/034107, 8 pages.
Non-Final Office Action dated Oct. 19, 2017 in U.S. Appl. No. 14/163,438, 18 pages.
Non-Final Office Action dated Oct. 27, 2017 in U.S. Appl. No. 14/566,215, 21 pages.
Final Office Action dated Nov. 1, 2017 in U.S. Appl. No. 14/495,252, 14 pages.
Office Action dated Feb. 12, 2018 in Australian Patent Application No. 2015361198, 3 pages.
Non-Final Office Action dated Mar. 7, 2018 in U.S. Appl. No. 14/721,450, 7 pages.
Non-Final Office Action dated Mar. 29, 2018 in U.S. Appl. No. 14/495,252, 14 pages.
Final Office Action dated Jun. 4, 2018 in U.S. Appl. No. 14/820,822, 14 pages.
Final Office Action dated Jul. 13, 2018 in U.S. Appl. No. 14/163,438, 14 pages.
Final Office Action dated Jun. 26, 2018 in U.S. Appl. No. 14/566,215, 16 pages.
Final Office Action dated Aug. 27, 2018 in U.S. Appl. No. 14/721,450, 8 pages.
International Search Report and Written Opinion dated Sep. 10, 2018 in International Patent Application No. PCT/US2018/035404, 13 pages.
Communication pursuant to Article 94(3) dated Nov. 22, 2018 in European Patent Application No. 16731401.2, 5 pages.
Communication pursuant to Article 94(3) dated Nov. 23, 2018 in European Patent Application No. 15787425.6, 7 pages.
Decision to grant a European patent pursuant to Article 97(1) dated Nov. 8, 2018 in European Patent Application No. 14737100.9, 1 page.
Non-Final Office Action dated Dec. 28, 2018 in U.S. Appl. No. 14/721,450, 6 pages.
Notice of Allowance dated Jan. 11, 2019 in U.S. Appl. No. 15/613,983, 7 pages.
Final Office Action dated Apr. 25, 2019 in U.S. Appl. No. 14/820,822, 15 pages.
Partial search report dated Apr. 26, 2019 in European Patent Application No. 18202740.9, 13 pages.
Final Office Action dated May 1, 2019 in U.S. Appl. No. 14/721,450, 6 pages.
Communication pursuant to Article 94(3) dated May 13, 2019 in European Patent Application No. 16001887.5, 4 pages.
Communication under Rule 71(3) dated May 16, 2019 in European Patent Application No. 16731401.2, 5 pages.
Communication under Rule 71(3) dated Jun. 21, 2019 in European Patent Application No. 15785032.2, 2 pages.
Non-Final Office Action dated Jul. 9, 2019 in U.S. Appl. No. 14/721,450, 6 pages.
Communication under Rule 71(3) dated Feb. 20, 2019 in European Patent Application No. 15785032.2, 5 pages.
Communication under Rule 71(3) dated Mar. 13, 2019 in European Patent Application No. 15787396.9, 5 pages.
Final Office Action dated Sep. 11, 2018 in U.S. Appl. No. 14/495,252, 14 pages.
Non-Final Office Action dated Sep. 18, 2018 in U.S. Appl. No. 15/613,983, 7 pages.
Non-Final Office Action dated Oct. 1, 2018 in U.S. Appl. No. 14/820,822, 15 pages.
Final Office Action received for U.S. Appl. No. 14/163,438, dated Jan. 13, 2020, 12 pages.
International Preliminary Report on Patentability received for PCT Patent Application No. PCT/US2018/035404, dated Dec. 12, 2019, 8 pages.
Office Action received for European Patent Application No. 15787425.6, dated Jan. 23, 2020, 6 pages.
Summons to Attend Oral Proceedings received for European Patent Application No. 16001887.5, dated Dec. 2, 2019, 5 pages.
Final Office Action received for U.S. Appl. No. 14/566,215, dated Jan. 30, 2020, 26 pages.
Extended Search Report dated Nov. 29, 2019 in European Patent Application No. 19192467.9, 5 pages.
Partial search report dated Dec. 9, 2019 in European Patent Application No. 19191026.4, 15 pages.
International Preliminary Report on Patentability dated Dec. 12, 2019 in International Patent Application No. PCT/US2018/035417, 8 pages.
International Preliminary Report on Patentability dated Dec. 12, 2019 in International Patent Application No. PCT/US2018/035408, 10 pages.
Non-Final Office Action dated Oct. 29, 2019 in U.S. Appl. No. 14/820,822, 15 pages.
International Search Report and Written Opinion dated Apr. 15, 2019 in International Patent Application No. PCT/US2018/061502, 18 pages.
Extended Search Report dated Aug. 16, 2019 in European Patent Application No. 18202740.9, 11 pages.
Non-Final Office Action dated Aug. 19, 2019 in U.S. Appl. No. 14/163,438, 15 pages.
Non-Final Office Action dated Aug. 21, 2009 in U.S. Appl. No. 14/566,215, 21 pages.
Notice of Allowance dated Sep. 16, 2019 in U.S. Appl. No. 14/721,450, 9 pages.
International Search Report and Written Opinion received for PCT Patent Application No. PCT/US2019/036495, dated Nov. 8, 2019, 20 pages.

(56) References Cited

OTHER PUBLICATIONS

Non-Final Office Action received for U.S. Appl. No. 15/993,195, dated Feb. 6, 2020, 16 pages.
Extended European Search Report received for European Patent Application No. 19191026.4, dated Mar. 12, 2020, 12 pages.
Office Action received for European Patent Application No. 16727106.3, dated Apr. 8, 2020, 6 pages.
Non-Final Office Action received for U.S. Appl. No. 15/993,180, dated Apr. 6, 2020, 13 pages.

* cited by examiner

BRAIDED ARTICLE WITH INTERNAL MIDSOLE STRUCTURE

BACKGROUND

The present embodiments relate generally to articles of footwear, and in particular to articles of footwear with uppers.

Articles of footwear generally include an upper and one or more sole structures. The upper may be formed from a variety of materials that are stitched or adhesively bonded together to form a void within the footwear for comfortably and securely receiving a foot. The sole structures may include midsole structures that provide cushioning and shock absorption.

SUMMARY

In one aspect, a method of making an upper for an article of footwear includes associating a midsole structure with a lower surface of a last. The method also includes inserting the last and the midsole structure through a braiding device while the midsole structure is associated with the lower surface of the last so as to form a braided structure around the last and the midsole structure, thereby forming the upper from the braided structure. The midsole structure is disposed within an interior cavity of the upper.

In another aspect, a method of making an article of footwear includes associating a midsole structure with a lower surface of a last. The method also includes inserting the last and the midsole structure through a braiding device while the midsole structure is associated with the lower surface of the last so as to form a braided structure around the last and the midsole structure, thereby forming an upper from the braided structure. The midsole structure is disposed within an interior cavity of the upper. The method also includes removing the last from the upper. The method also includes attaching an outer sole structure to a lower portion of the upper, where the outer sole structure includes a ground engaging surface, thereby forming the article of footwear.

In another aspect, an article of footwear includes an upper having a braided structure. The upper includes an interior cavity and an opening providing entry to the interior cavity. The upper includes a closed lower portion. A midsole structure is disposed within the interior cavity such that the midsole structure is disposed closer to an inner surface of the lower portion than an outer surface of the lower portion. An outer sole structure is attached to the outer surface of the lower portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
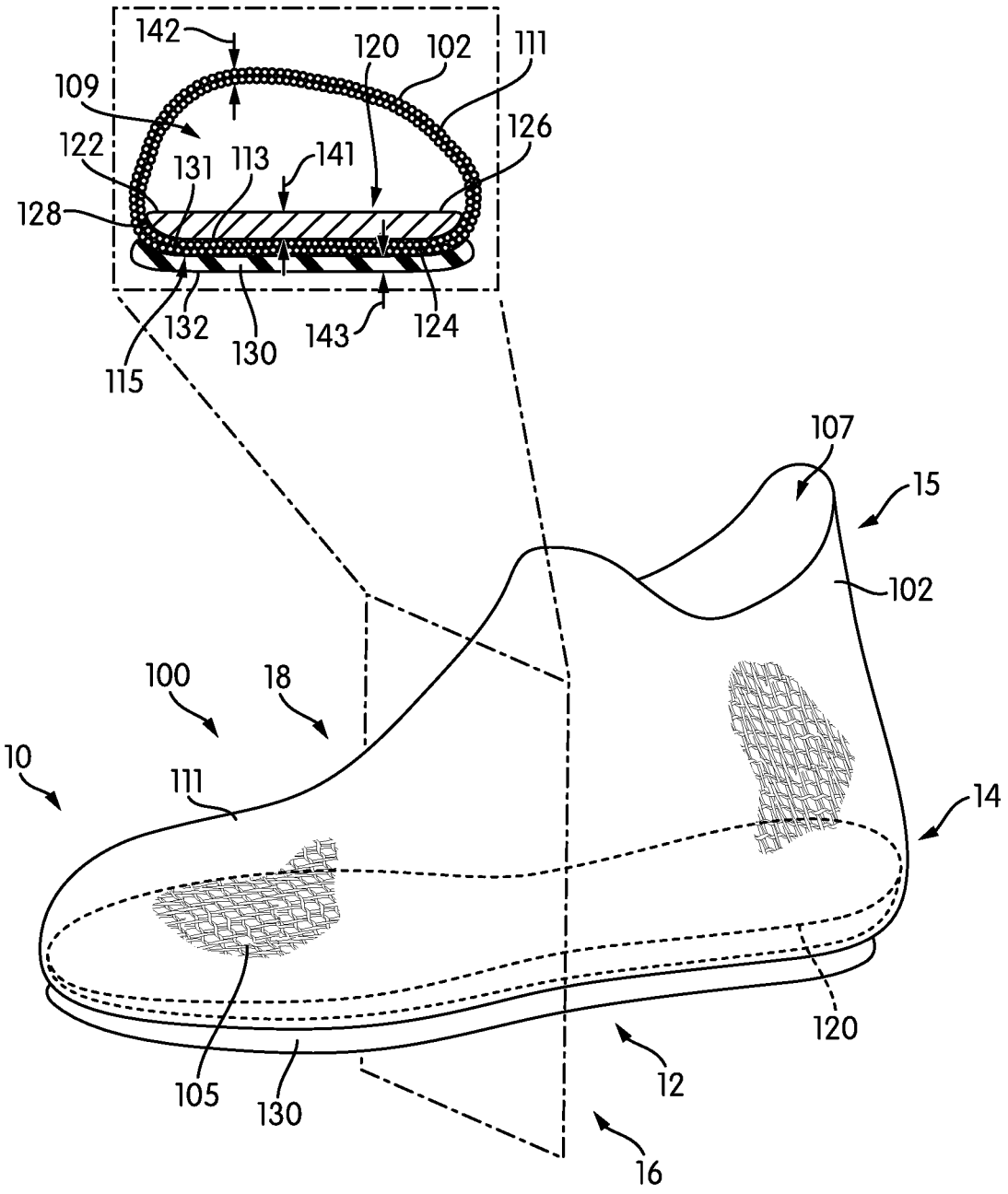
FIG. 1 is a schematic isometric view of an embodiment of an article of footwear including an enlarged cross-sectional view of a forefoot portion of the article of footwear.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of a midsole structure, an outer sole structure, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion and an ankle portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include an ankle portion 15 (which may also be referred to as a cuff portion). In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14 and ankle portion 15.

Figure 2:
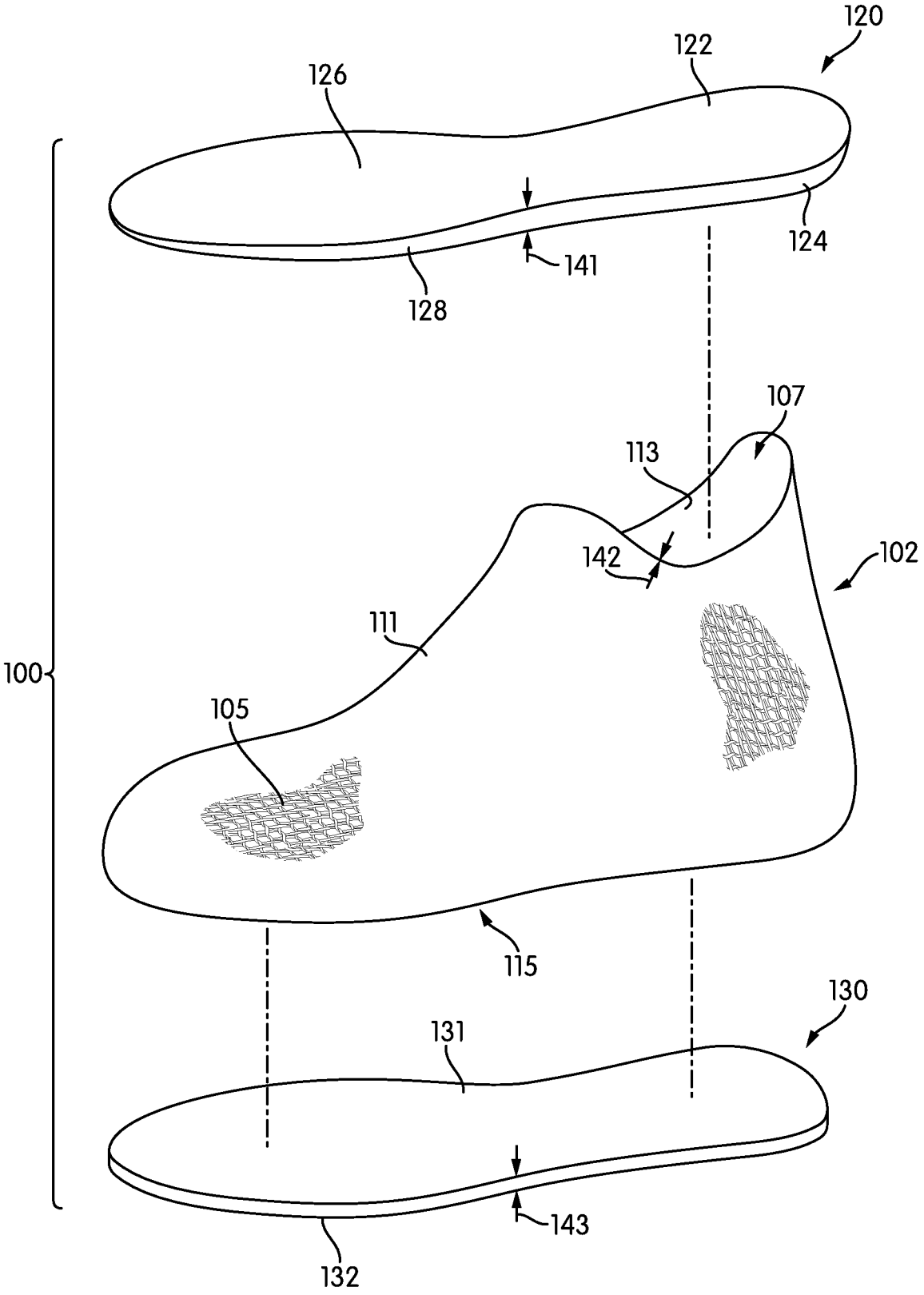
FIG. 2 is a schematic isometric exploded view of the article of footwear of FIG. 1.

FIGS. 1-2 illustrate various components of article of footwear 100, including an upper 102, a midsole structure 120 and an outer sole structure 130. For purposes of illustration, in FIG. 1, midsole structure 120 is shown in phantom in the isometric view of article 100.

Upper 102 may be a braided upper. More specifically, upper 102 may comprise a braided structure having the form of an upper for an article of footwear. As used herein, the term "braided structure" (or braided component) refers to any structure that may be formed by intertwining three or more tensile elements to form the structure. Such tensile elements could include, but are not limited to: threads, yarns, strings, filaments, fibers, wires, cables as well as possibly other kinds of tensile elements. As used herein, tensile elements may describe generally elongated materials with lengths much greater than corresponding diameters. In other words, tensile elements may be approximately one-dimensional elements, in contrast to sheets or layers of textile materials that may generally be approximately two-dimensional (e.g., with thicknesses much less than their lengths and widths). As an example, upper 102 as seen in FIGS. 1-2 is formed from a plurality of tensile elements 105 (e.g., yarns or strands of material) that are braided together to form a shape that is globally similar to the shape of a foot. For purposes of illustration, the individual tensile elements 105 are only shown in representative patches on upper 102 in the figures, but it may be understood that in at least some embodiments the entirety of upper 102 may comprise tensile elements 105 in a braided configuration.

Braiding can be used to form three-dimensional structures, by braiding strands of yarn over a form or a last. Strands of a braided structure, such as plurality of tensile elements 105 of the exemplary embodiment, can be fabricated from fibers such as nylon, carbon, polyurethane, polyester, cotton, aramid (e.g., Kevlar®), polyethylene or polypropylene. These strands can be braided to form three-dimensional structures for a wide variety of applications.

Braided structures may be fabricated manually, or may be manufactured using automated braiding machinery, such as the machinery disclosed in U.S. Pat. Nos. 7,252,028; 8,261,648; 5,361,674; 5,398,586; and 4,275,638, all of which are incorporated by reference in their entirety herein. One exemplary manufacturing method, including the use of a radial braiding machine, is discussed below and shown in FIG. 7.

Some embodiments may include braided uppers that extend beneath the foot, thereby providing 360 degree coverage at some regions of the foot. However, other embodiments need not include uppers that extend beneath the foot. In other embodiments, for example, a braided upper could have a lower periphery joined with a sole structure and/or sock liner. In the exemplary embodiment, upper 102 includes a closed lower portion 115 (see FIGS. 1-3) that extends beneath a foot when the article is worn.

Embodiments could incorporate any of the braided structures, methods of making braided structure as well as any of the related provisions that are disclosed in U.S. patent application Ser. No. 14/495,252 filed Sep. 24, 2014, published as U.S. Publication Number 2015/0007451, and titled "Article of Footwear with Braided Upper," the entirety of which is herein incorporated by reference and hereafter referred to as "the Braided Upper application".

Referring to FIGS. 1-2, upper 102 is seen to have an opening 107 that may receive a foot. Opening 107 may provide access to an interior cavity 109 of upper 102. In the exemplary embodiment, upper 102 may have a bootie-like configuration without any additional fasteners. Depending on the material of the individual tensile strands 105, the exemplary embodiment may be configured to stretch fit over a foot without the need for additional fasteners. For example, using tensile strands 105 with elastic properties may allow upper 102 to stretch over a foot and provide the needed amount of tension to keep article 100 on the foot. However, in other embodiments, upper 102 could incorporate fastening provisions including laces, straps, zippers or other kinds of fasteners that may help secure upper 102 around a foot. For example, other embodiments could utilize any of the fastening provisions for a braided upper that are disclosed in the Braided Upper application.

Upper 102 may also be characterized by an outer surface 111, which is an exterior or exposed surface. In addition, upper 102 may include an inner surface 113 that is opposite outer surface 111.

Midsole structure 120 may generally incorporate various provisions associated with midsoles. In different embodiments, a midsole structure may be configured to provide cushioning, shock absorption, energy return, support, as well as possibly other provisions.

Midsole structure 120 may comprise an exterior surface 122. Exterior surface 122 may be further comprised of a first surface 124 and a second surface 126 disposed opposite of first surface 124. Here, first surface 124 may be a lower surface of midsole structure 120, while second surface 126 may be an upper surface of midsole structure 120. Moreover, first surface 124 may include a first surface periphery 128 (e.g., a lower surface periphery), which extends around the boundary of first surface 124. In some cases, first surface periphery 128 may be associated with the sides (or sidewalls) of midsole structure 120. Second surface 126 may extend from first surface periphery 128 (i.e., second surface 126 is proximate to, or even continuous with, first surface periphery 128) and across the top side of midsole structure 120.

In different embodiments, the geometry of midsole structure 120 could vary. In some embodiments, midsole structure 120 may have a two-dimensional geometry (e.g., a geometry in the plane spanned by the longitudinal and lateral directions) corresponding to a foot sole. In other embodiments, however, the geometry of midsole structure 120 could vary and could include various contours or features not associated with a foot sole.

In different embodiments, the dimensions of midsole structure 120 could vary. In some embodiments, midsole structure 120 has a length approximately equal to a length of upper 102, as midsole structure 120 may extend through the entirety of interior cavity 109 in the longitudinal direction. In other embodiments, however midsole structure 120 could have a length less than the length of upper 102. For example, in another embodiment, a midsole structure may only extend through the midfoot and heel portions of an article of footwear. In some embodiments, midsole structure 120 has a width approximately equal to a width of upper 102, as midsole structure 120 may extend through the entire of interior cavity 109 in the lateral direction. However, in other embodiments, a midsole structure could only extend partially across the width of upper 102.

In some embodiments, the thickness of midsole structure 120 may vary. In some embodiments, a midsole structure could be thicker than either an upper or an outer sole structure. In other embodiments, a midsole structure could be thinner than an upper and/or an outer sole structure. In some cases, a midsole structure could be equal in thickness to an upper and/or a sole structure. In the exemplary embodiment, midsole structure 120 has a thickness 141 that corresponds to the distance between first surface 124 and second surface 126 of midsole structure 120. In addition, upper 102 has a thickness 142 and outer sole structure 130 has a thickness 143. Moreover, thickness 141 is greater than thickness 142. Also, thickness 141 is greater than thickness 143. This relatively greater thickness for midsole structure 120 may ensure that midsole structure 120 provides a larger degree of the shock absorption, cushioning and/or support than may be provided by the material structures of upper 102 and outer sole structure 130.

A midsole structure may be formed from a variety of different materials. Exemplary materials that could be used in various embodiments include, but are not limited to: expanded rubber, foam rubber, various kinds of foams, polyurethane as well as possibly other materials. For example, in one embodiment, a midsole structure may be formed from a polymer foam material that attenuates ground reaction forces (i.e., provides cushioning) during walking, running, and other ambulatory activities. In various embodiments, midsole structures may also include fluid-filled chambers, plates, moderators, or other elements that further attenuate forces, enhance stability, or influence the motions of the foot, for example.

Outer sole structure 130 may include provisions for cushioning and/or may include provisions to enhance ground contact. In some embodiments, outer sole structure 130 could primarily comprise an outsole. In such embodiments, the outsole forms a ground-contacting element of the footwear and is usually fashioned from a durable and wear-resistant rubber material that includes texturing to impart traction. In other embodiments, outer sole structure 130 could also include cushioning provisions, including provisions associated with a midsole layer.

In the embodiments of FIGS. 1-2, outer sole structure 130 may be characterized by a first surface 131 and a second surface 132 that is opposite of first surface 131. First surface 131 may face inwardly, or towards upper 102, while second surface 132 may face outwardly and may be a ground contacting surface. In some embodiments, second surface 132 could include provisions for enhancing traction with a ground surface such as treads, cleats, or other provisions.

As seen in FIGS. 1-2, midsole structure 120 may be disposed within upper 102. Specifically, midsole structure 120 may be disposed within interior cavity 109 of upper 102. In some cases, first surface 124 of midsole structure 120 (i.e., a lower surface) may be disposed against inner surface 113 of upper 102. In other cases, first surface 124 of midsole structure 120 could be disposed against an intermediate layer, or may be otherwise spaced apart from inner surface 113 of upper 102. In either case, midsole structure 120 may be disposed closer to inner surface 113 of lower portion 115 (of upper 102) than to outer surface 111 of lower portion 115. Such an arrangement may be contrasted with other possible embodiments, where a midsole structure may be disposed externally to an upper and therefore disposed closer to an outer surface of the upper than to the inner surface of the upper.

Outer sole structure 130 may be disposed against outer surface 111 of upper 102. More specifically, first surface 131 outer sole structure 130 may be disposed against outer surface 111 on lower portion 115 of upper 102. Thus, whereas midsole structure 120 may be disposed within interior cavity 109 of upper 102, outer sole structure 130 may be disposed outwardly on upper 102. Therefore, lower portion 115 of upper 102 may separate, or be disposed between, midsole structure 120 and outer sole structure 130.

Figure 3:
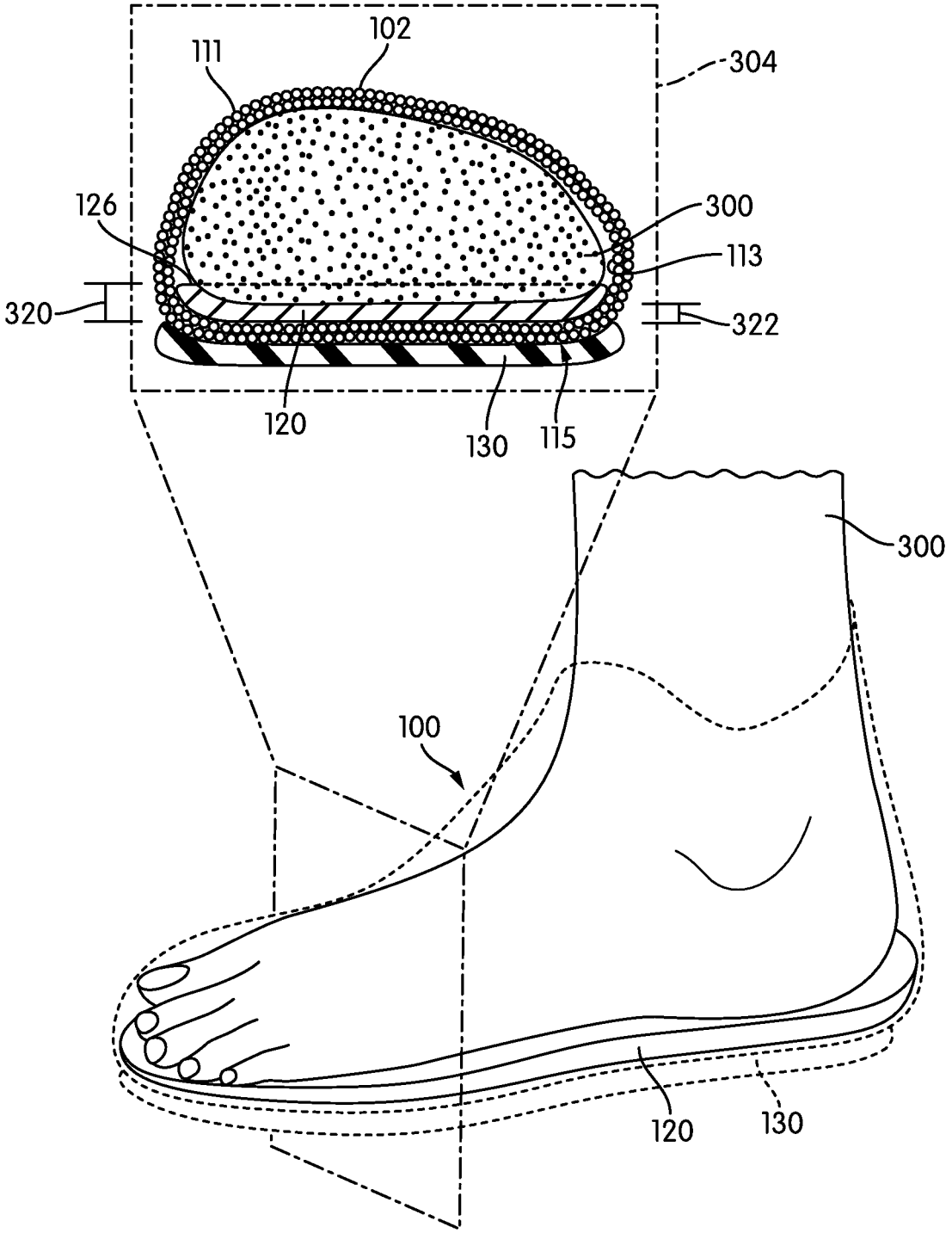
FIG. 3 is a schematic view of the article of FIG. 1 with a foot inserted within an upper, including an enlarged cross-sectional view of a forefoot portion of the article of footwear and foot.

For purposes of clarity, article 100 is shown without an inner liner or insole. In such an embodiment, a foot (or sock worn on the foot) may directly contact a surface of a midsole structure. For example, in some embodiments, second surface 126 of midsole structure 120 may be configured to receive and contact a foot directly. Such an exemplary configuration is shown in FIG. 3, which shows a schematic view of a foot 300 inserted within article of footwear 100 along with a cross-sectional view of the article and foot as taken along a vertical plane 304. In the configuration of FIG. 3, foot 300 directly contacts second surface 126 of midsole structure 120. In other embodiments, however, an optional insole or inner liner could be present between a foot and midsole structure 120 when article 100 is worn. Such a liner or insole may be disposed on second surface 126 of midsole structure 120.

Each component may be characterized by various material characteristics, including cushioning and compressibility. In various embodiments, the relative material characteristics of each component (e.g., upper 102, midsole structure 120 and outer sole structure 130) could be varied. In one exemplary embodiment, midsole structure 120 may provide greater cushioning than either upper 102 or outer sole structure 130. In addition, in one embodiment, midsole structure 120 may be more compressible than upper 102 and midsole structure 120 may be more compressible than outer sole structure 130.

The exemplary embodiment shown in FIG. 3 shows the relative compressibility of midsole structure 120 relative to upper 102 and outer sole structure 130. For example, midsole structure 120 is seen to compress under the weight of foot 300. Specifically, midsole structure 120 undergoes a change from an uncompressed thickness 320 to a compressed thickness 322. In contrast, upper 102 does not undergo any significant compression (e.g., change in thickness) at lower portion 115 under the weight of foot 300. Likewise, outer sole structure 130 does not undergo any significant compression under the weight of foot 300.

In different embodiments, the degree of relative compressibility between midsole structure 120 and other components of article 100 can vary. In at least some embodiments, midsole structure 120 can undergo changes in thickness due to compressive forces (e.g., weight of foot or other ground contact forces) that are greater than the thickness of upper 102. In other words, the change in thickness (e.g., between uncompressed thickness 320 and compressed thickness 322) could be greater than a thickness of upper 102 (e.g., thickness 142 as shown in FIG. 1). The degree of compression for a given force can vary according to factors including but not limited to: desired cushioning properties, midsole structure materials, midsole structure geometry as well as possibly other factors. Moreover, the compression of midsole structure 120 can be tuned to achieve optimal comfort and cushioning for a user.

In different embodiments, the attachment configurations of various components of article 100 could vary. For example, in some embodiments, midsole structure 120 could be bonded or otherwise attached to an inner surface of upper 102. Such bonding or attachment could be accomplished using any known methods for bonding components of articles of footwear, including, but not limited to: adhesives, films, tapes, staples, stitching, or other methods. In some other embodiments, it is contemplated that midsole structure 120 may not be bonded or attached to upper 102, and instead could be free-floating.

Outer sole structure 130 may be attached to upper 102 and/or midsole structure 120. In some embodiments, outer sole structure 130 could be attached directly to upper 102 using various attachment methods including, but not limited to: adhesives, tapes, staples, stitching, or other methods. In one embodiment, outer sole structure 130 and/or upper 102 could include one or more heat bonding materials (e.g., thermoplastics or other resins) that may act as a bonding layer between outer sole structure 130 and upper 102 when heated.

It is also contemplated that in at least some embodiments, outer sole structure 130 may be attached directly to midsole structure 120 through openings in the braided structure of upper 102 (e.g., through the spaces between strands). Thus, in at least some cases, an adhesive could be applied to first surface 131 of outer sole structure 130 to bond outer sole structure 130 to upper 102 and portions of midsole structure 120 simultaneously. In still other embodiments, outer sole structure 130 and/or midsole structure 120 could be made of heat bondable materials, so that after arranging outer sole structure 130 and midsole structure 120 relative to upper 102, heat may be applied to melt and bond outer sole structure 130 and midsole structure 120 to one another. In such cases, outer sole structure 130 and midsole structure 120 could be formed from bond compatible materials. Such an arrangement where outer sole structure 130 is attached directly to midsole structure 120 may help to anchor outer sole structure 130 to article 100.

In order to form a braided upper with an internal midsole structure, a midsole structure may first be temporarily attached to a last. The last with the temporarily attached midsole structure (also referred to collectively as a lasting assembly) may then be fed through a braiding device (such as a radial braiding machine) to form a braided structure in the form of a braided upper around the last and midsole structure. Upon removal of the last, a braided upper with an internal midsole structure may be assembled with an outer sole structure to form an article of footwear, similar to article 100 discussed above and shown in FIGS. 1-3.

Figure 4:
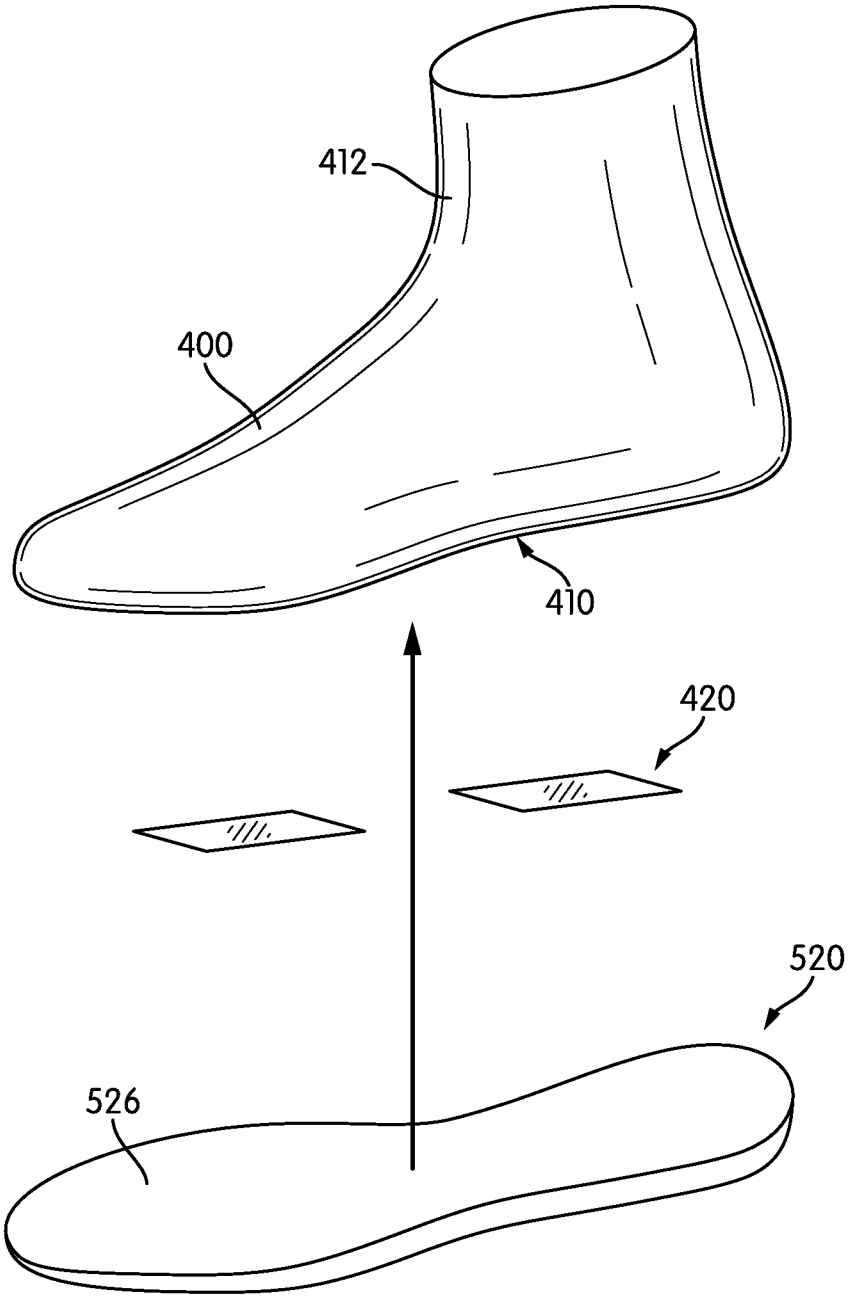
FIG. 4 is a schematic isometric view of a step of temporarily attaching a midsole structure to a last, according to an embodiment.
Figure 5:
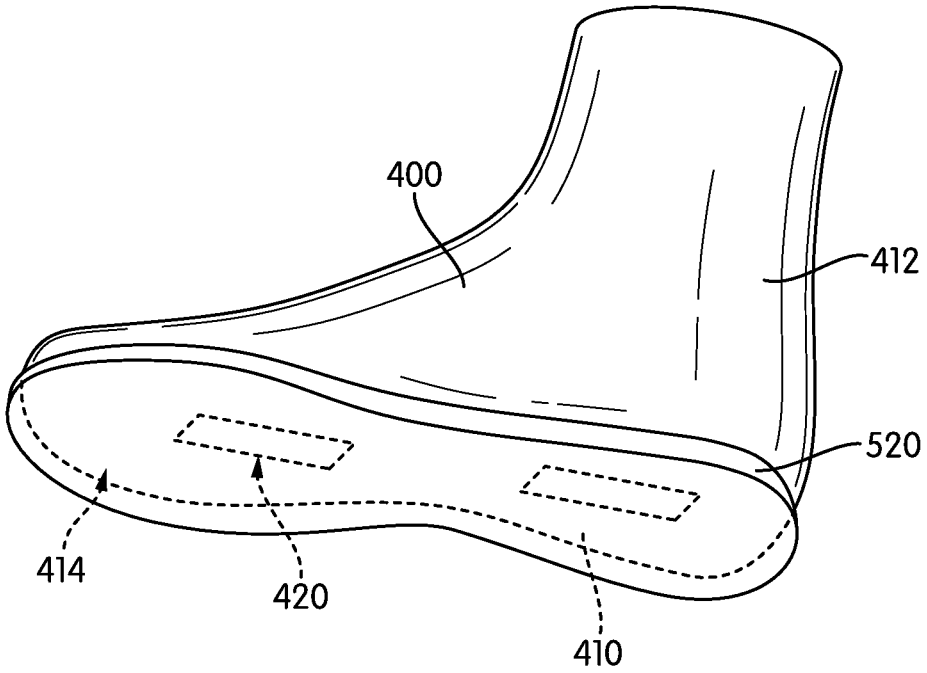
FIG. 5 is a schematic bottom isometric view of an embodiment of a midsole structure temporarily attached to a last.

FIGS. 4 and 5 illustrate schematic steps in a process of making an article of footwear, such as article 100, according to an embodiment. Specifically, FIG. 4 illustrates an exploded isometric view of a last 400 (i.e., a footwear last), adhesive film elements 420 and midsole structure 520. FIG. 5 illustrates a bottom isometric view of midsole structure 520 attached to last 400 using adhesive film elements 420. It will be understood that midsole structure 520 may be similar to midsole structure 120 of the embodiments shown in FIGS. 1-3, and may optionally include some or all of the provisions discussed with respect to midsole structure 120.

In FIGS. 4 and 5, a process of temporarily attaching midsole structure 120 to last 400 may be accomplished using adhesive film elements 420. In particular, second surface 526 of midsole structure 120 may be temporarily bonded to a lower surface 410 (i.e., a sole surface) of last 400 by inserting adhesive film elements 420 between second surface 126 and lower surface 410.

For purpose of clarity, only two film elements are shown, however in other embodiments any number, size, and arrangement of adhesive film elements could be used. In other embodiments, of course, any other method of temporarily fixing, attaching, bonding, adhering or otherwise temporarily joining a midsole structure with a last could be used. Exemplary methods include, but are not limited to, the use of adhesives, films, tapes, putties, as well as possibly other methods. It is contemplated that in some embodiments a last could be configured with a fastening element (such as a screw or other projection) and a midsole structure could be configured with provisions to receive the fastening element (such as a threaded hole to receive a screw). Thus, in some embodiments, a last and a midsole structure could be temporarily secured using some kind of mechanical fasteners, including, but not limited to: screws, bolts, hook and loop fasteners, clips, straps, as well as possibly other mechanical provisions. The method of temporarily joining a midsole structure and a last can be selected according to various factors including: last material and/or dimensions, midsole structure material and/or dimensions, as well as possibly other factors.

For purposes of understanding the arrangement of midsole structure 520 and last 400, last 400 may be characterized as comprising various different portions. For example, last 400 may include not only a lower surface 410 (i.e., the sole surface of last 400), but also an upper surface 412. As used herein, the term "upper surface" of a last refers to the area of the last surface that does not include lower surface 410, which is the surface of the last corresponding to the sole of a foot. Thus, upper surface 412 may generally include the medial side surface, the lateral side surface as well as the upper, forward and rearward surfaces of last 400. Upper surface 412 may generally extend to, or join, a lower surface periphery 414 of lower surface 410.

As seen in FIGS. 4 and 5, midsole structure 520, when temporarily attached to last 400, covers only lower surface 410 of last 400. In particular, upper surface 412 may be exposed when midsole structure 120 is temporarily attached to last 400. Such an arrangement may be in contrast, for example, to the placement of a bootie-like liner over last 400, which would tend to cover both lower surface 410 and upper surface 412. In other words, the exemplary configuration of a component applied to last 400 is one where the component (a midsole structure) is applied only to a local portion of last 400, namely the lower surface 410 of last 400, rather than being uniformly applied over last 400 as in the case of a liner or other intermediate layer.

In order to enhance the operation of a braiding device, such as a radial braiding machine, it may be important to use last assemblies having smooth geometries. For purposes of clarity in characterizing the smoothness of these geometries, the term peripheral contour is used herein to denote the contour or boundary of a given cross-sectional area of a component. Additionally, contours, or lines that bound a given cross-sectional area, can be characterized as having curvature that may vary over different sections of the contour. In the present discussion, the curvature of a given section of a contour may be described by a radius of curvature and the curvature of different sections can be compared according to the differences in their radii of curvature.

Figure 6:
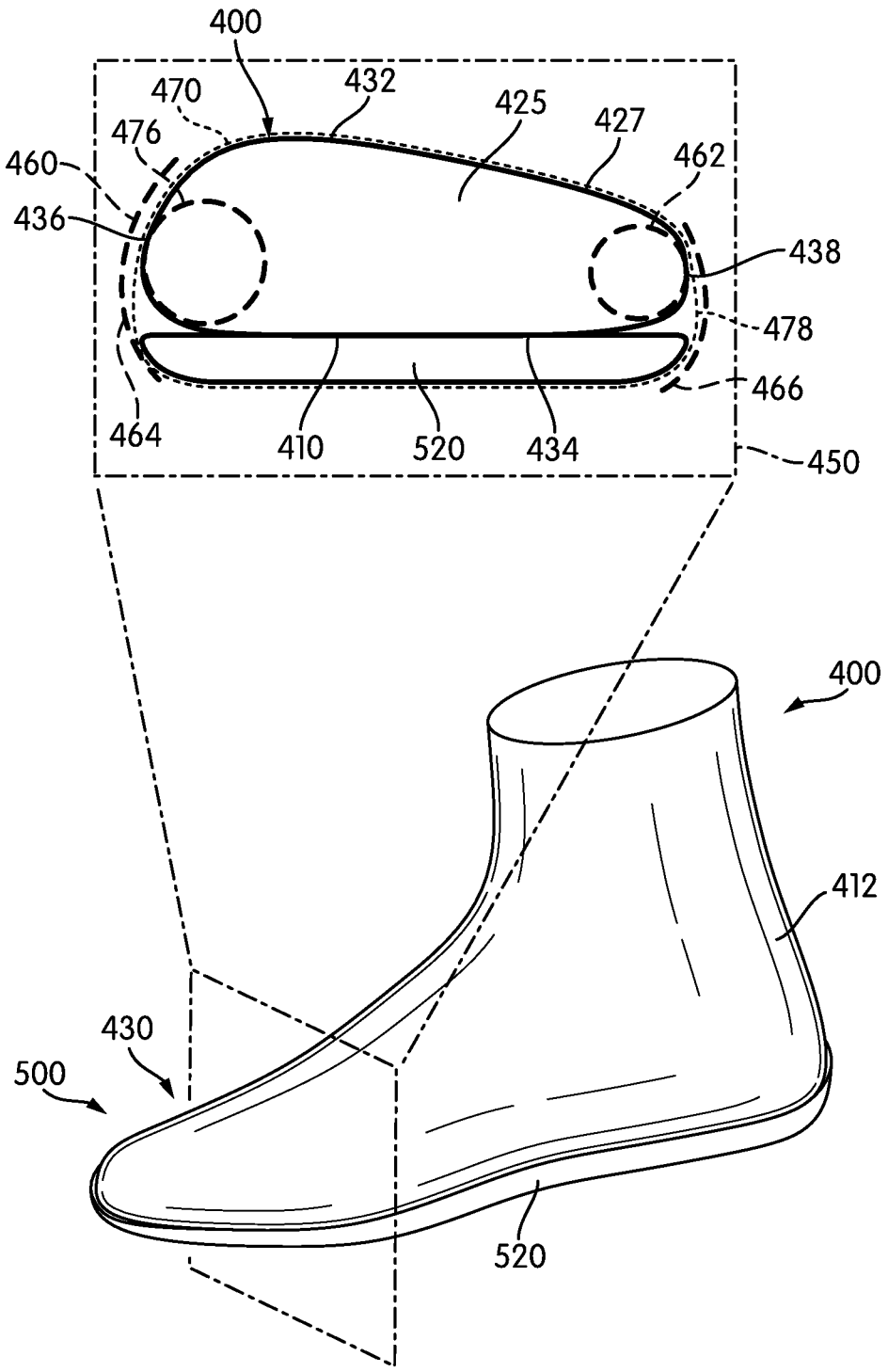
FIG. 6 is a schematic isometric view of the last and midsole structure of FIG. 5, including an enlarged cross-sectional view of the last and midsole structure.

FIG. 6 illustrates an isometric view of lasting assembly 500, comprising last 400 and midsole structure 520, including an enlarged cross-sectional view of a portion of lasting assembly 500. In particular, a cross-sectional view of forefoot portion 430 of last 400 is shown taken along a plane 450. As seen in FIG. 6, forefoot portion 430 has a cross-sectional area 425 and a peripheral contour 427 that bounds the cross-sectional area 425. Peripheral contour 427 may further be comprised of a top portion 432, a bottom portion 434, a medial side portion 436 and a lateral side portion 438.

As shown in FIG. 6, medial side portion 436 and lateral side portion 438 may be representative of portions of the exterior surface of last 400 where the curvature is relatively high and non-constant. For example, medial side portion 436 may have a first curvature, represented in FIG. 6 by first radius of curvature 460. Additionally, lateral side portion 438 may have a second curvature, represented in FIG. 6 by second radius of curvature 462.

As shown in FIG. 6, when temporarily attached to last 400, midsole structure 520 may help reduce regions of high curvature. In FIG. 6, last 400 and midsole structure are seen to provide a combined peripheral contour 470. The combined peripheral contour 470 represents the peripheral contour that will be presented to a braiding machine during formation of a braided upper. In this case, a medial side portion 476 of combined peripheral contour 470 has a third radius of curvature 464 and a lateral side portion 478 of combiner peripheral contour 470 has a fourth radius of curvature 466.

As clearly seen in FIG. 6, the geometry of combined peripheral contour 470 may be different than the geometry of the last 400. For example, combined peripheral contour 470 is significantly less curved on the medial and lateral sides of last 400 and midsole structure 520. Specifically, third curvature 464 may be substantially less than first curvature 460 on the medial sides of last 400 and midsole structure 520. Likewise, fourth curvature 466 may be substantially less than second curvature 462 on the lateral sides of last 400 and midsole structure 520. Because of this reduced curvature on the lateral and medial sides, last 400 and midsole structure 120 may together present a smoother peripheral contour (e.g., a cross-sectional area with a smoother boundary) to a braiding machine than would be presented by last 400 alone.

It will be understood that the curvature of last 400 may vary over different portions from the curvature depicted for forefoot portion 430. It may be appreciated that in other portions where last 400 may have high curvature the addition of midsole structure 120 may also help present a smoother contoured periphery to the braiding machine.

Figure 7:
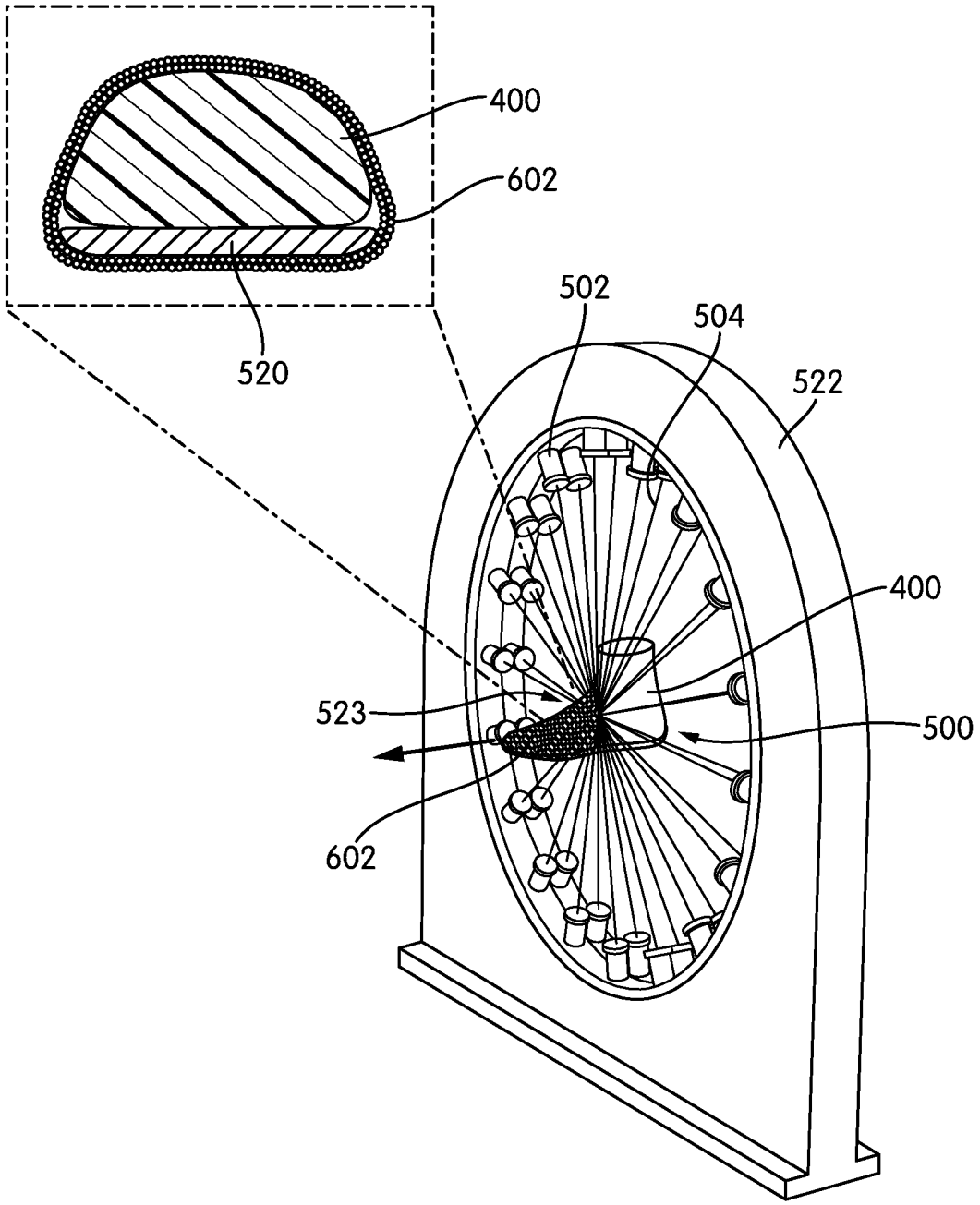
FIG. 7 is a schematic isometric view of an embodiment of a last and midsole structure inserted through a braiding device to form a braided structure over the last and midsole structure.

FIG. 7 illustrates a step of inserting lasting assembly 500 (i.e., last 400 and midsole structure 520) through a braiding device 522. In some embodiments, braiding device 522 may include provisions for over-braiding strands onto a lasting assembly. In the configuration shown in FIG. 7, braiding device 522 includes spools 502 with threads 504 that may be over-braided onto last 400 and midsole structure 520 as these components are inserted through a central braiding area 523 of braiding device 522.

In some embodiments, lasting assembly 500 may be manually fed through braiding device 522 by a human operator. In other embodiments, a continuous last feeding system can be used to feed lasting assembly 500 through braiding device 522. The present embodiments could make use of any of the methods and systems for forming a braided upper disclosed in the Braided Upper application.

As shown in FIG. 7, as lasting assembly 500 is fed through braiding device 522, a braided structure 602 is formed around last 400 and midsole structure 120. In this case, braided structure 602 forms a continuously braided upper that conforms to last 400 and midsole structure 120, and therefore has the approximate geometry of the combination of last 400 and midsole structure 120.

In some embodiments, methods of braiding may also include provisions for holding and/or feeding articles through braiding device 522. For example, some embodiments may include support platforms (not shown) that can facilitate feeding articles through braiding device 522. Generally, any systems known in the art for feeding objects through a braiding machine could be used. In some embodiments, a conveyor system could be used to automatically move a footwear last through braiding device 522. In some other embodiments, each footwear last could be manually inserted through braiding device 522.

As seen in FIG. 7, the exemplary method provides a generally rounded cross-sectional shape without any regions of high curvature that might interfere with the over-braiding process.

Figure 8:
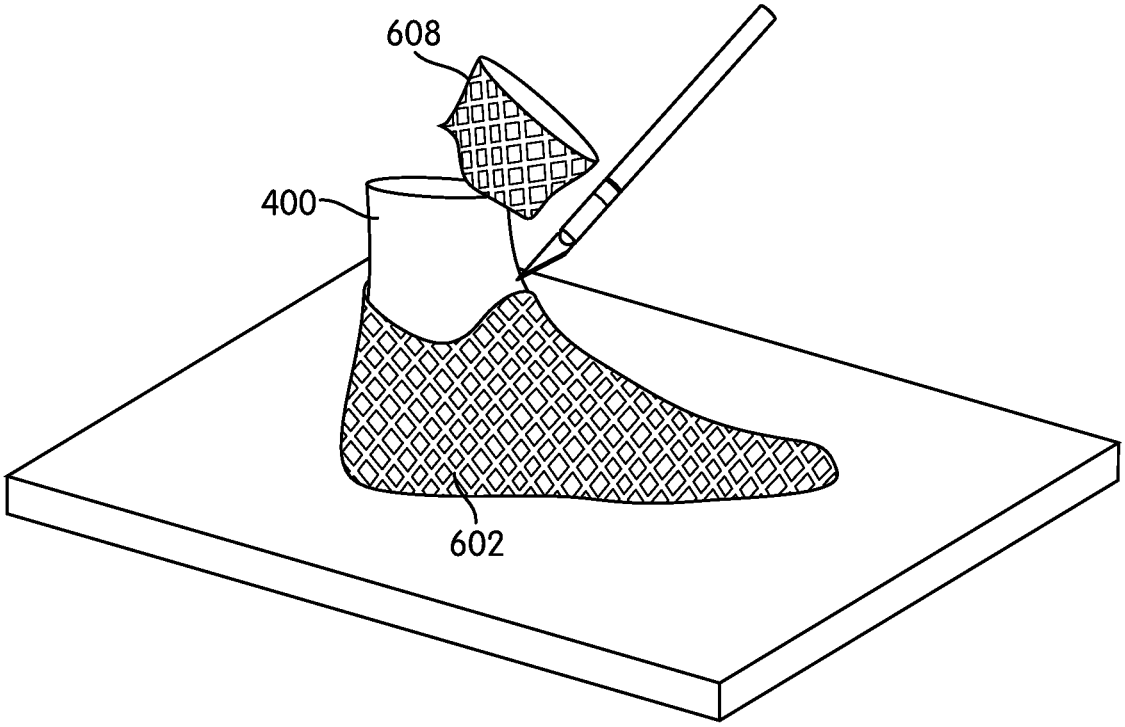
FIG. 8 is a schematic isometric view of a braided upper being cut to form an opening according to an embodiment.
Figure 9:
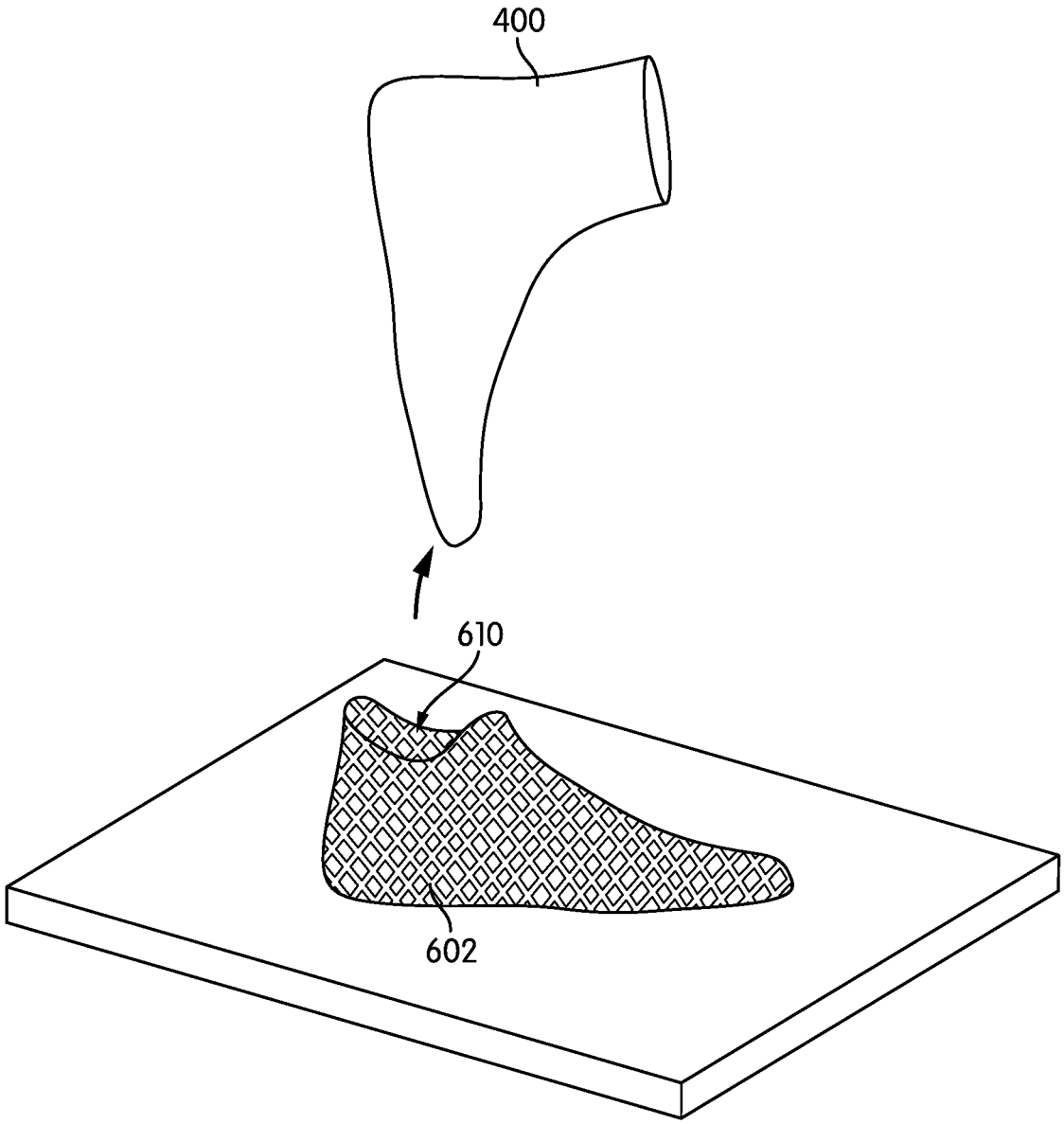
FIG. 9 is a schematic view of a last being removed from a braided upper according to an embodiment.

FIGS. 8-9 illustrate a schematic view of a step of cutting a braided structure 602 and removing last 400. In some cases, as schematically shown in FIGS. 8-9, after forming braided footwear structure 602, a section 608 of braided footwear structure 602 can be cut or otherwise removed to form an opening 610 in braided footwear structure 602. In some cases, last 400 can be removed from opening 610, which may further serve as an opening for a foot.

Although not shown here, some embodiments can also include provisions for assembling trim, overlay, or other components or portions of material for assembly with a braided structure. As used herein, the term "overlay" refers to any material layer that could be disposed over a layer of braided material, including braided material for an upper. Overlays could be comprised of any kinds of materials and may be configured with a variety of different characteristics (e.g., stretch, elasticity, density, weight, durability, breathability, etc.). Also, overlays could have any dimensions and could be configured to cover some portions and/or all portions of a braided structure. Overlays could be disposed on an interior surface of a braided structure and/or an exterior surface of a braided structure. Embodiments could use any of the overlays, and/or methods for attaching overlays to braided structure, disclosed in U.S. patent application Ser. No. 14/163,438, filed Jan. 24, 2014, published as U.S. Patent Publication Number 2014/0373389, and titled "Braided Upper with Overlays for Article of Footwear," the entirety of which is herein incorporated by reference.

Figure 10:
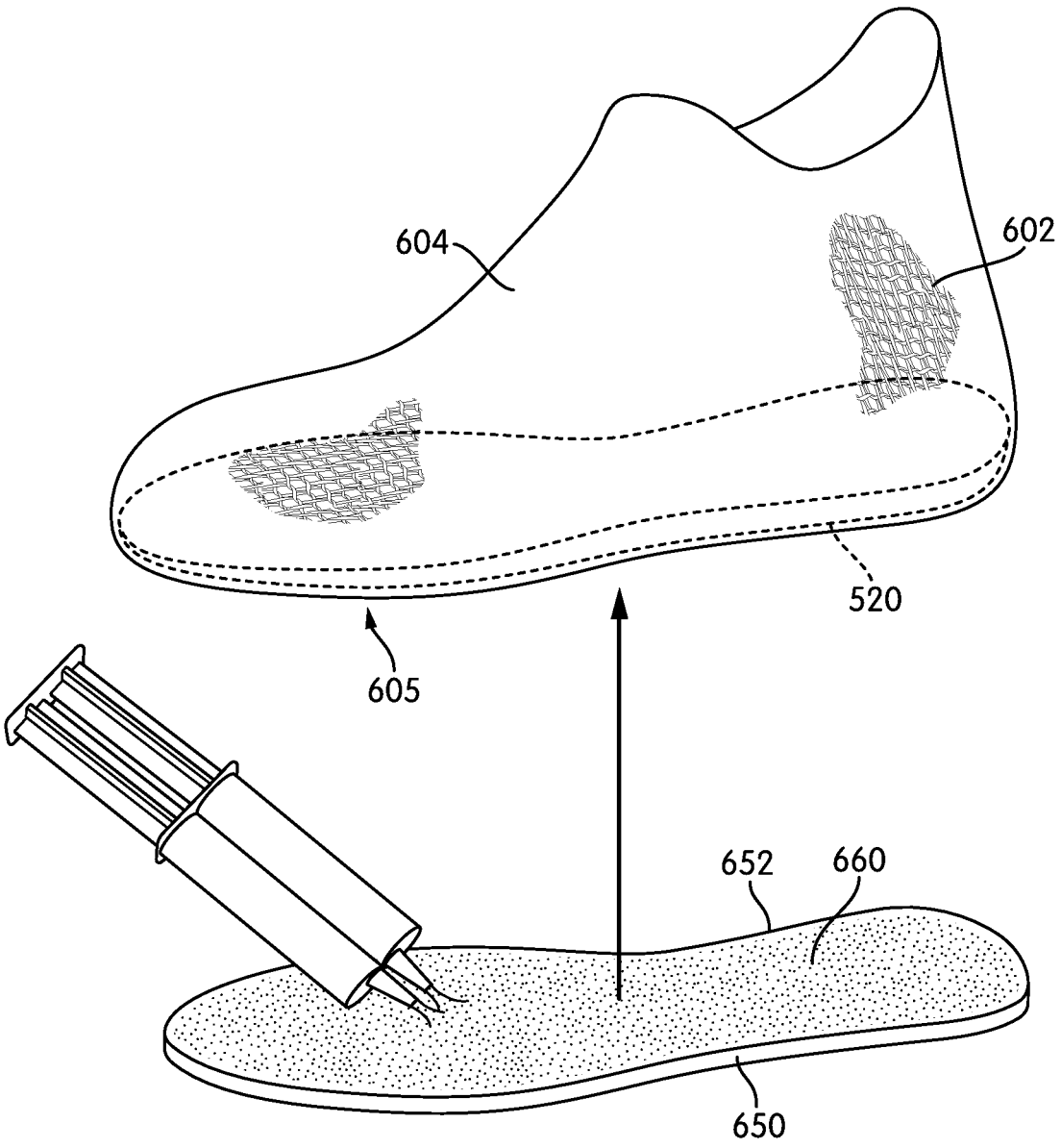
FIG. 10 is a schematic view of an outer sole structure being attached to a lower surface of a braided upper according to an embodiment.

FIG. 10 illustrates an isometric view of an embodiment of a braided upper 604 formed from braided structure 602 (incorporating internal midsole structure 520) being assembled with an outer sole structure 650. Here, surface 652 of outer sole structure 650 may be temporarily bonded to a lower surface 605 (i.e., a sole surface) of braided upper 604 using an adhesive 660 between surface 652 and lower surface 605. In other embodiments, of course, any other method of temporarily fixing, attaching, bonding, adhering or otherwise temporarily joining an outer sole structure with an upper could be used. Exemplary methods include, but are not limited to, the use of adhesives, films, tapes, as well as possibly other methods. Still other embodiments may not include an outer sole structure. Further, in other embodiments, additional sole components or layers could be incorporated between an outer sole structure and a braided upper.

Embodiments could use any methods for manufacturing braided articles including uppers with internal midsoles. In particular, embodiments could use any of the methods of braiding uppers, forming and attaching overlay structures (using 30 printing and high frequency welding) as well any other methods, systems or provisions disclosed in U.S. patent application Ser. No. 14/565,582, filed Dec. 10, 2014, published as U.S. Patent Publication Number 2016/0166011, and titled on entitled "Portable Manufacturing System for Articles of Footwear," the entirety of which is herein incorporated by reference.

Figure 11:
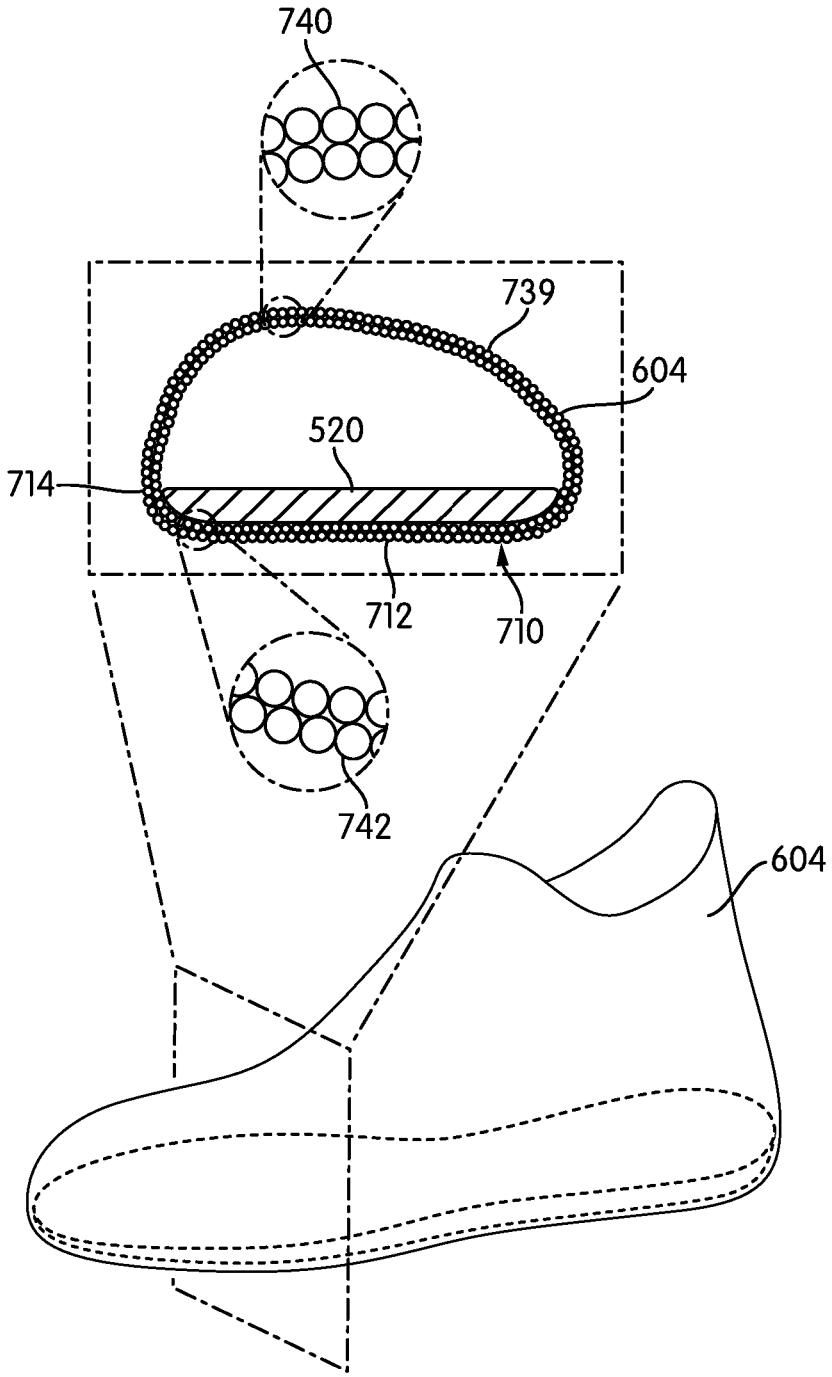
FIG. 11 is a schematic view of an embodiment of an upper with an interior midsole structure.
Figure 12:
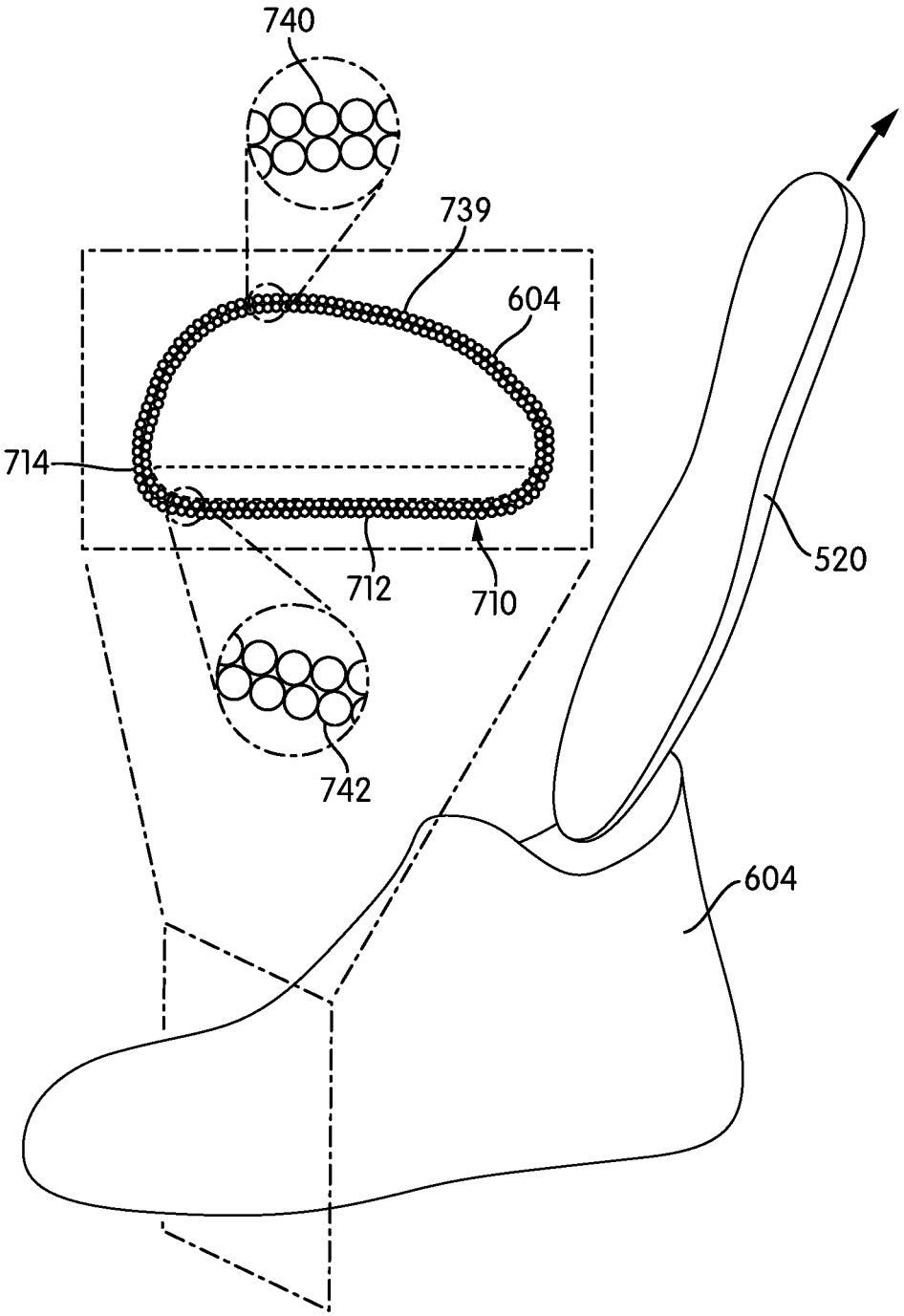
FIG. 12 is a schematic view of the upper of FIG. 11 with the midsole structure removed.

FIGS. 11-12 illustrate schematic views of upper 604 with internal midsole structure 520 (FIG. 11) and without midsole structure 520 (FIG. 12). It will be understood that FIG. 12 is only intended for purposes of clarifying provisions of the exemplary designs. In particular, in some embodiments a midsole structure may not be removable and instead may be permanently disposed within an interior cavity of an upper.

As seen by comparing the enlarged cross-sectional views in FIG. 11 and FIG. 12, upper 604 maintains an approximately identical cross-sectional shape between the two configurations. Specifically, the lower portion 710 of upper 604, associated with lower surface 712 and peripheral side surfaces 714 of upper 604, may not change in geometry or dimension even when midsole structure 520 is removed in the configuration of FIG. 12. This consistent geometry for lower portion 710 may be due to the process of forming upper 604. Specifically, tensile strands are braided around midsole structure 520 so that the resulting braided structure has a geometry that corresponds with the contours of midsole structure 520 in a relaxed or un-tensioned state of upper 604. For example, as shown in FIG. 12, at a top portion 739 of upper 604 the strands 740 of the braided structure may be spaced apart by a similar amount to strands 742 in lower portion 710 of the braided structure, thereby indicating roughly even tension throughout upper 604 in this state.

Figure 13:
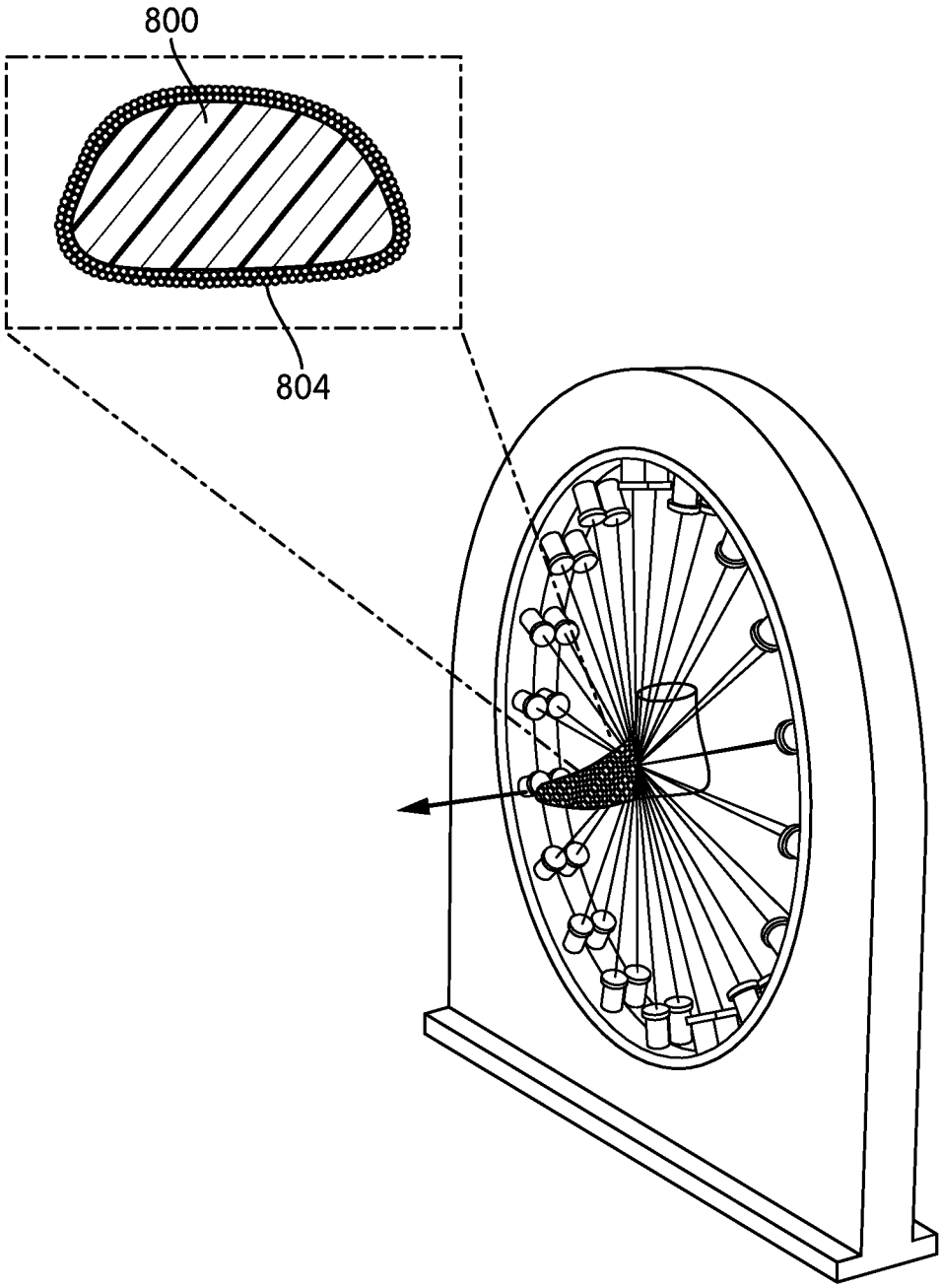
FIGS. 13-15 illustrate schematic views of an alternative embodiment of an upper formed from a braided structure, where the upper is formed on a last and a midsole structure is inserted after the upper is formed on the last.
Figure 14:
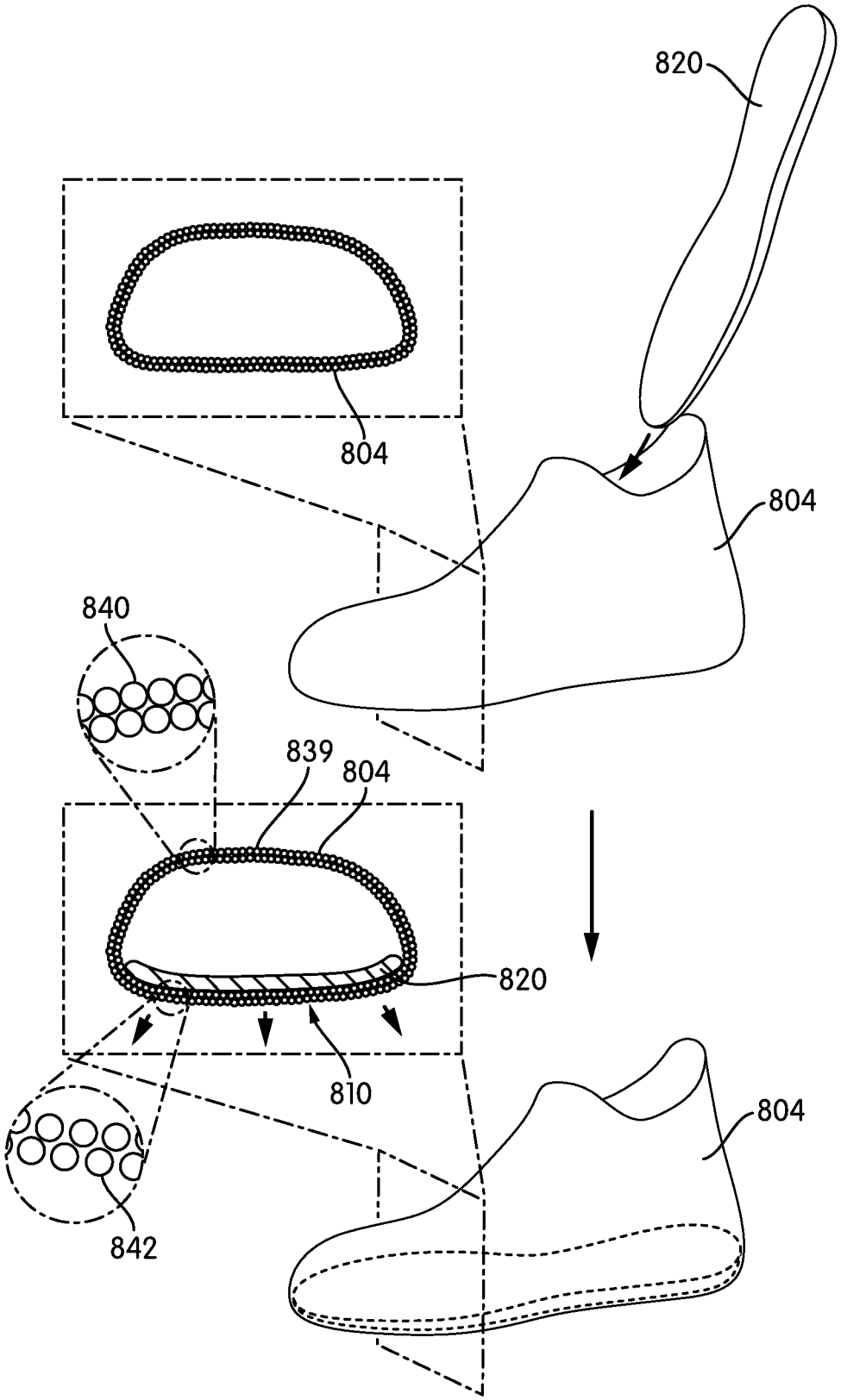
Figure 15:
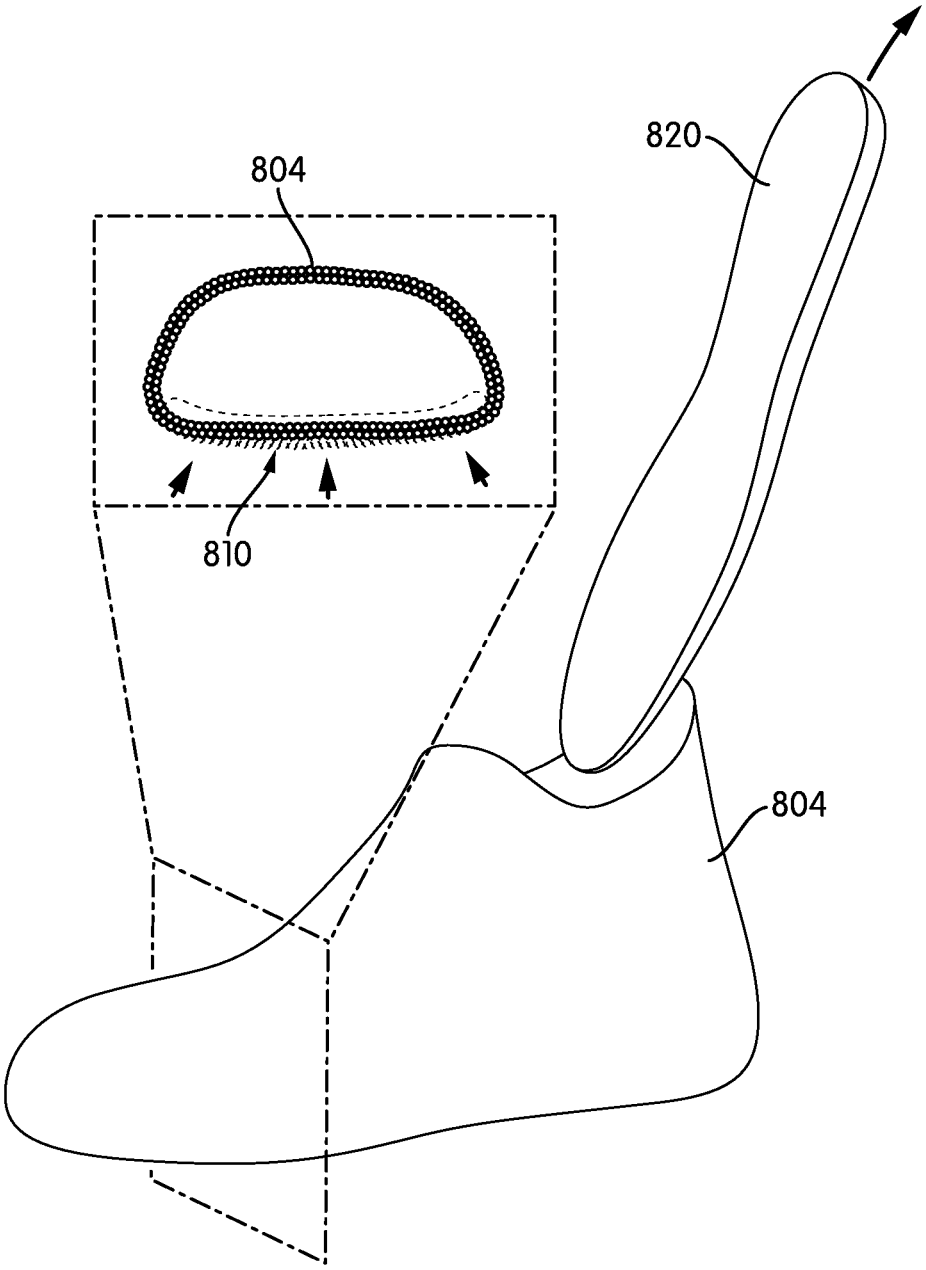

Such a configuration for upper 604 may be in contrast to alternative embodiments in which a midsole structure is inserted after the upper has been formed in an over-braiding process (or other braiding process). For example, in an alternative embodiment shown in FIGS. 13-15, a braided upper 804 may be formed on a last 800 without a midsole structure (FIG. 13). Next, once braided upper 804 has been formed (and last 800 removed), a midsole structure 820 may be inserted into braided upper 804, as shown in FIG. 14. In this case, braided upper 804 must stretch, especially at a lower portion 810, to accommodate the contours of midsole structure 820. Such stretching may result in increased tension at lower portion 810 of braided upper 804, which is tension within upper 804 caused by the presence of midsole structure 820. Finally, FIG. 15 illustrates that if midsole structure 820 is removed from braided upper 804, braided upper 804 may revert to an earlier configuration where the geometry of lower portion 810 fails to retain the contours of midsole structure 820 (i.e., lower portion 810 no longer has a geometry corresponding to midsole structure 820). This may occur as upper 804 contracts with the removal of midsole structure 820.

In contrast to the embodiment of FIGS. 11-12, the embodiment shown in FIGS. 13-15 results in greater stretching in some portions of upper 804 due to the presence of midsole structure 820. Specifically, in lower portion 810 of upper 802 the strands 842 of the braided structure are spaced further apart than the strands 840 in top portion 839 of the braided structure, indicating an uneven tension throughout upper 802.

By forming an upper so that the upper geometry accommodates a midsole structure without stretching, as occurs in the exemplary embodiments shown in FIGS. 1-12, the upper may be made more resilient and may also more easily accommodate additional tensions from ground contact forces, bending, etc.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A method of making a braided article of footwear having an internal midsole structure, the method comprising:

temporarily associating the internal midsole structure with a lower surface of a last to form a lasting assembly, wherein the internal midsole structure covers only the lower surface of the last, wherein the last comprises a first peripheral contour having a first set of one or more radii of curvature and the lasting assembly comprises a second peripheral contour having a second set of one or more radii of curvature, and wherein each of the first set of one or more radii of curvature of the last are smaller than each of the second set of one or more radii of curvature of the lasting assembly;

inserting the lasting assembly through a braiding device;

braiding one or more tensile strands over the lasting assembly so as to form a braided upper around the lasting assembly, the braided upper having a third peripheral contour that corresponds to the second peripheral contour of the lasting assembly;

removing the last from the braided upper, wherein the one or more braided tensile strands located on a top portion of the braided upper are spaced apart by a similar amount to the one or more braided tensile strands located in a lower portion of the braided upper in the braided article of footwear having the internal midsole structure; and affixing an outer sole structure to the lower portion of the braided upper, wherein a first thickness of the internal midsole structure is greater than a second thickness of the braided upper, wherein the first thickness of the internal midsole structure is also greater than a third thickness of the outer sole structure, and wherein the internal midsole structure comprises cushioning properties and is more compressible than the braided upper and the outer sole structure.

2. The method according to claim 1, wherein temporarily associating the midsole structure with the lower surface of the last includes temporarily bonding the midsole structure to the lower surface of the last.

3. The method according to claim 2, wherein the method includes applying a bonding material between the midsole structure and the lower surface of the last.

4. The method according to claim 3, wherein the bonding material is an adhesive film.

5. The method according to claim 3, wherein the bonding material is a liquid adhesive layer.

6. The method according to claim 1, wherein the lower surface of the last includes a lower surface periphery, wherein the last further includes an upper surface extending to the lower surface periphery.

7. The method according to claim 1, wherein the braiding device is a radial braiding machine.

8. A method of making an article of footwear, the method comprising:

applying an adhesive material between an upper surface of a midsole structure, which is a foot facing surface when the article of footwear is worn by a wearer, and a lower surface of a last configured to resemble a plantar surface of a foot of the wearer when the article of footwear is worn by the wearer, to temporarily associate the upper surface of the midsole structure with the lower surface of the last to form a combined last and midsole structure, wherein the last comprises a first peripheral contour having a first set of one or more radii of curvature wherein the combined last and midsole structure comprises a second peripheral contour having a second set of one or more radii of curvature, and wherein each radii of curvature of the first set of one or more radii of curvature of the last are smaller than each radii of curvature of the second set of one or more radii of curvature of the combined last and midsole structure;

inserting the combined last and midsole structure through a braiding device so as to form a braided upper around the combined last and midsole structure by braiding one or more tensile strands over the combined last and midsole structure, wherein the midsole structure is disposed within an interior cavity of the braided upper;

removing the last from the braided upper, wherein the one or more braided tensile strands located on a top portion of the braided upper are spaced apart by a similar amount to the one or more braided tensile strands located in a lower portion of the braided upper having the midsole structure disposed within; and attaching an outer sole structure to the lower portion of the braided upper, the outer sole structure including a ground engaging surface, thereby forming the article of footwear, wherein a first thickness of the midsole structure is greater than a second thickness of the braided upper, and wherein the first thickness of the midsole structure is also greater than a third thickness of the outer sole structure, wherein the midsole structure comprises cushioning properties and is more compressible than the braided upper and the outer sole structure.

9. The method according to claim 8, wherein the midsole structure is made of a first material, the upper is made of a second material and the outer sole structure is made of a third material, and wherein the first material is different from the second material and the third material is different from the second material.

10. The method according to claim 9, wherein the first material is different from the third material.

11. A braided article of footwear manufactured according to claim 1, comprising:

(a) the braided upper, wherein the braided upper includes an interior cavity and an opening providing entry to the interior cavity and wherein the braided upper includes a closed lower portion;

(b) the midsole structure disposed within the interior cavity such that the midsole structure is disposed closer to an inner surface of the lower portion than an outer surface of the lower portion; and (c) the outer sole structure attached to the outer surface of the lower portion.

12. The article of footwear according to claim 11, wherein the lower portion is disposed between the midsole structure and the outer sole structure.

13. The article of footwear according to claim 11, wherein the midsole structure is bonded to the inner surface of the lower portion of the upper.

* * * * *